US009701132B2

(12) United States Patent
Hirose et al.

(10) Patent No.: US 9,701,132 B2
(45) Date of Patent: Jul. 11, 2017

(54) IMAGE FORMATION APPARATUS AND METHOD USING CLEANING TRANSFER AND UNUSED FRAME CUEING

(71) Applicant: G-PRINTEC INC., Yokohama-shi, Kanagawa (JP)

(72) Inventors: Kaku Hirose, Yokohama (JP); Keiji Ihara, Yokohama (JP); Yuji Okada, Yokohama (JP)

(73) Assignee: G-PRINTEC INC., Yokohama-Shi, Kanagawa (JP)

( * ) Notice: Subject to any disclaimer, the term of this patent is extended or adjusted under 35 U.S.C. 154(b) by 0 days.

(21) Appl. No.: 14/982,520

(22) Filed: Dec. 29, 2015

(65) Prior Publication Data

US 2016/0214397 A1 Jul. 28, 2016

(30) Foreign Application Priority Data

Jan. 23, 2015 (JP) ..... 2015-010998
Jan. 23, 2015 (JP) ..... 2015-011004

(51) Int. Cl.
*B41J 2/36* (2006.01)
*B41J 2/325* (2006.01)

(52) U.S. Cl.
CPC ..... *B41J 2/36* (2013.01)

(58) Field of Classification Search
CPC ..... B41J 2/36; B41J 2/325
USPC ..... 347/195, 215
See application file for complete search history.

(56) References Cited

U.S. PATENT DOCUMENTS 4,890,121 A * 12/1989 Hirahara ..... H04N 1/40087 347/184

FOREIGN PATENT DOCUMENTS

JP 4337582 B2 7/2009

* cited by examiner

*Primary Examiner* — Huan Tran
*Assistant Examiner* — Alexander D Shenderov
(74) *Attorney, Agent, or Firm* — Nath, Goldberg & Meyer; Jerald L. Meyer

(57) ABSTRACT

An image formation apparatus capable of forming images of good quality over a long term on image formation target objects is provided. The image formation target object has a plurality of transfer frames, and the image formation apparatus has a control unit configured to control a formation of the image with respect to at least one of the transfer frames such that the image includes an image of a first range that is transferred and formed in a density within a first density range for which a first density is a maximum density, and an image of a second range that is transferred and formed in a second density that is higher density than the first density, after the first range.

3 Claims, 24 Drawing Sheets

IMAGE FORMATION APPARATUS AND METHOD USING CLEANING TRANSFER AND UNUSED FRAME CUEING

CROSS-REFERENCE TO RELATED APPLICATIONS

This application claims benefit of priority to Japanese Patent Application No. 2015-011004 filed on Jan. 23, 2015, and Japanese Patent Application No. 2015-010998 filed on Jan. 23, 2015, the entire contents of which are incorporated by reference herein.

FIELD OF THE INVENTION

The present invention relates to image formation apparatus and method suitable for a printing apparatus of a re-transfer scheme.

BACKGROUND OF THE INVENTION

There is a known image formation apparatus for forming a color image by transferring ink of respective colors by sublimation or melting from an ink ribbon on which a set of ink layers in a plurality of colors are repeatedly applied in a ribbon direction, to an identical transfer region on an image formation target object by using a thermal head.

In Japanese Patent No. 4,337,582, a printing apparatus of a re-transfer scheme that contains this image formation apparatus is described. The ink ribbon to be used in this printing apparatus has four colors of yellow (Y), magenta (M), cyan (C), and black (BK), and the image formation target object is a ribbon shaped intermediate transfer film.

In the printing apparatus as disclosed in Japanese Patent No. 4,337,582, the color image is formed by transferring the ink of respective colors to an identical transfer region (hereafter the transfer region is also referred to as a frame) in the intermediate transfer film one color by one color, as the thermal head is put in pressed contact with a face on opposite side of the ink layer, while moving the ink ribbon in a ribbon direction with its ink layer overlapping with the intermediate transfer film.

Namely, for each color, operations of separating the thermal head, winding and cueing one frame part of the intermediate transfer film, and putting the thermal head into pressed contact are carried out in this order.

Consequently, in order to form the color image using the ink of four colors, a cueing operation is carried out four times (a winding operation is carried out three times), for the intermediate transfer film.

In Japanese Patent No. 4,337,582, in each set of the ink layers on the ink ribbon, a cueing mark 11*c* for the purpose of a cueing operation for each set is given in advance to a leading position of the ink layer of the yellow (Y) that is the first transfer color. Also, a frame mark 21*d* for the purpose of a cueing operation for a frame is given in advance to a leading position of each frame in the intermediate transfer film.

The printing apparatus as disclosed in Japanese Patent No. 4,337,582 has a re-transfer apparatus (or a re-transfer unit) for carrying out a re-transfer operation in which the color image that has been formed on the intermediate transfer film is transferred again to a re-transfer target object such as a card.

Now, to a face on opposite side (hereafter also referred to as a back face) of a face on a side applied with the ink layer (hereafter also referred to as an ink face) in the ink ribbon, in order to make a sliding movement of the thermal head smooth, a lubricant is applied as a back coat agent.

The lubricant has a lubricating property with a different temperature characteristic for each type.

For example, among the general purpose lubricants of relatively low cost, there are those for which the lubricating property becomes lower in a temperature range to which the temperature is raised by the thermal head at a time of continuously carrying out the transfer in low to medium density, than the other temperature ranges.

In the case of using the ink ribbon applied with this lubricant on the back face, when the transfer in low to medium density is carried out continuously, there is a high possibility for the lubricant to be peeled off due to the lowered lubricating property on the thermal head, and the peeled off lubricant to be attached and deposited on a surface of the thermal head, more specifically the heating resistors of the thermal head.

When the lubricant is attached and deposited on a surface of the heating resistors of the thermal head, it becomes harder for the heat energy to be transmitted to the ink layer, so that a partial transfer density lowering (uneven density) occurs in the formed image.

The image formation apparatus is loaded with various ink ribbons including the ink ribbon applied with such a lubricant that has a potential danger of the lowering of the lubricating property.

For this reason, it is desired for the image formation apparatus to be able to form images in good quality over a long term on image formation target objects, by devising a measure to make it harder for the lubricant of the ink ribbon to be attached and deposited on the heating resistors of the thermal head.

Also, in the image formation apparatus, when a trouble such as a card transportation error occurs in a course of transfer to one frame in the intermediate transfer film, the operation of the image formation apparatus or the printing apparatus as a whole is made to stop as an error processing. At this point, the thermal head is positioned in a middle of the frame, and the frame during the transfer remains in a state of being transferred up to a middle.

From this state, when the power is turned OFF once and then the power is turned ON again after a recovery operation, there are cases where the frame that is already transferred up to a middle on which the thermal head is positioned is erroneously recognized as a completely unused frame, and the printing is restarted by cueing that frame again to result in an improper printing.

Also, there are cases where the intermediate transfer film in which frames up to a middle among a plurality of frames are set as already used will be taken out from the apparatus once, for the purpose of the maintenance of the image formation apparatus and the like.

In that case, the intermediate transfer film will be taken out along with the detachable winding reel and supply reel.

Then, after the maintenance, at a time of installing the intermediate transfer film again along with the winding reel and the supply reel, the operation for searching a position of an unused frame in the intermediate transfer film has been carried out by the visual observation, while bridging over and feeding the intermediate transfer film from the winding reel to the supply reel.

For this reason, the maintenance efficiency is lowered, and there are concerns for causing a trouble such as unused frames are left behind or the transfer is carried out again from the already used frame, because of the failure in the cueing.

From these, there is a demand for the image formation apparatus that is capable of carrying out the cueing of an unused frame in the image formation target object in which frames up to a middle of the plurality of frames are set as already used and remaining frames are set as unused, in good quality and efficiency.

SUMMARY OF THE INVENTION

It is therefore an object of the present invention to provide image formation apparatus and method capable of forming images in good quality over a long term on image formation target objects.

It is another object of the present invention to provide image formation apparatus and method capable of carrying out a cueing of an unused frame on an image formation target object on which an image is to be transferred and formed, in good quality and efficiency.

According to one aspect of the present invention, there is provided an image formation apparatus, comprising: a platen roller; a thermal head configured to relatively separate/contact with respect to the platen roller, wherein an ink ribbon and an image formation target object are moved in pressed contact between the platen roller and the thermal head and ink of the ink ribbon is transferred to the image formation target object to form an image on the image formation target object, and the image formation target object has a plurality of transfer frames that are partitioned; and a control unit configured to control a formation of the image with respect to at least one of the transfer frames such that the image includes an image of a first range that is transferred and formed in a density within a first density range for which a first density is a maximum density, and an image of a second range that is transferred and formed in a second density that is higher density than the first density, after the first range.

In this image formation apparatus, the control unit may be configured to control the second density to be greater than or equal to 1.2 and less than or equal to 2.0, when the first density range is greater than or equal to 0 and less than or equal to 1.0, and control a number of lines for transferring and forming the image of the second range to be greater than or equal to 10.

In this image formation apparatus, the thermal head may have n sets of heating resistors, where n is an integer greater than or equal to 2, and the control unit may be configured to control the formation of the image such that the image of the second range is transferred and formed independently in correspondence with each one of the n sets of the heating resistors.

In this image formation apparatus, the control unit may be configured to count a number of times for which each one of the n sets of the heating resistors has a temperature raised into a prescribed temperature range, and control the formation of the image such that the image of the second range is transferred and formed by using those ones of the heating resistors for which the counted number of times reached a prescribed number of times.

This image formation apparatus may further comprises a re-transfer unit configured to re-transfer a part of the image of the first range transferred and formed on the image formation target object to a re-transfer target object.

According to another aspect of the present invention, there is provided an image formation method for forming an image on an image formation target object by transferring ink of an ink ribbon to the image formation target object by an operation of a thermal head, wherein the image formation target object has a plurality of transfer frames that are partitioned, and the method is forming the image with respect to at least one of the transfer frames by: the first step of transferring and forming an image of a first range in a density within a first density range for which a first density is a maximum density; and the second step of transferring and forming an image of a second range in a second density that is higher density than the first density, after the first step.

In this image formation method, the second step may control the second density to be greater than or equal to 1.2 and less than or equal to 2.0, when the first density range is greater than or equal to 0 and less than or equal to 1.0, and control a number of lines for transferring and forming the image of the second range to be greater than or equal to 10.

In this image formation method, the thermal head may have n sets of heating resistors, where n is an integer greater than or equal to 2, and the second step may be such that the image of the second range is transferred and formed independently in correspondence with each one of the n sets of the heating resistors.

In this image formation method, the second step may be such that a number of times for which each one of the n sets of the heating resistors has a temperature raised into a prescribed temperature range is counted, and the image of the second range is transferred and formed by using those ones of the heating resistors for which the counted number of times reached a prescribed number of times.

According to the present invention, it is possible to provide image formation apparatus and method capable of forming images in good quality over a long term on image formation target objects.

According to still another aspect of the present invention, there is provided an image formation apparatus, comprising: a platen roller; a thermal head configured to relatively separate/contact with respect to the platen roller, wherein an ink ribbon and a ribbon shaped image formation target object are moved in pressed contact between the platen roller and the thermal head and ink of the ink ribbon is transferred to a transfer frame on the image formation target object to form an image on the image formation target object, and the image formation target object has a plurality of transfer frames and a frame mark at a boundary portion of each transfer frame; a frame mark sensor configured to detect the frame mark; and a control unit configured to include an already used mark that is capable of being detected by the frame mark sensor at an end of a transfer of the image, and carry out a cueing operation for an unused transfer frame according to a presence or absence of a detection of the already used mark in a detection signal outputted from the frame mark sensor.

In this image formation apparatus, the already used mark may be formed as the image of the second range.

In this image formation apparatus, the ink ribbon may have a yellow ink layer, a magenta ink layer, a cyan ink layer and a black ink layer, and the control unit may be configured to form the image as a color image by a selective superposed transfer of ink of the yellow ink layer, the magenta ink layer, the cyan ink layer and the black ink layer, and form the already used mark by including ink of at least either one of the cyan ink layer and the black ink layer.

This image formation apparatus may further comprise a re-transfer unit configured to re-transfer a part of the image formed on the image formation target object to a re-transfer target object.

According to still another aspect of the present invention, there is provided an image formation method for forming an image on a ribbon shaped image formation target object by transferring ink of an ink ribbon to a transfer frame in the image formation target object by an operation of a thermal head, the method comprising: forming in advance frame marks for partitioning a plurality of transfer frames at constant intervals arranged in a ribbon direction on the image formation target object, wherein the frame marks are capable of being detected by a frame mark sensor; transferring an already used mark capable of being detected by the frame mark sensor at an end of a transfer of the image; and carrying out a cueing operation for an unused transfer frame according to a presence or absence of a detection of the already used mark in a detection signal outputted from the frame mark sensor.

In this image formation method, the already used mark may be formed as the image of the second range.

In this image formation method, the ink ribbon may have a yellow ink layer, a magenta ink layer, a cyan ink layer and a black ink layer, and the method may further comprise: forming the image as a color image by a selective superposed transfer of ink of the yellow ink layer, the magenta ink layer, the cyan ink layer and the black ink layer, and forming the already used mark by including ink of at least either one of the cyan ink layer and the black ink layer.

According to the present invention, it is possible to provide image formation apparatus and method capable of carrying out a cueing of an unused frame on an image formation target object on which an image is to be transferred and formed, in good quality and efficiency.

DETAILED DESCRIPTION OF THE INVENTION

The image formation apparatus according to embodiments of the present invention will be described as the first embodiment (an image formation apparatus 51) and the second embodiment (an image formation apparatus 51A) with references to FIG. 1 to FIG. 17.

First, the printing apparatus PR of the re-transfer scheme that has the image formation apparatus 51 of the first embodiment will be described with references to FIG. 1 to FIG. 15.

(First Embodiment)

Figure 1:
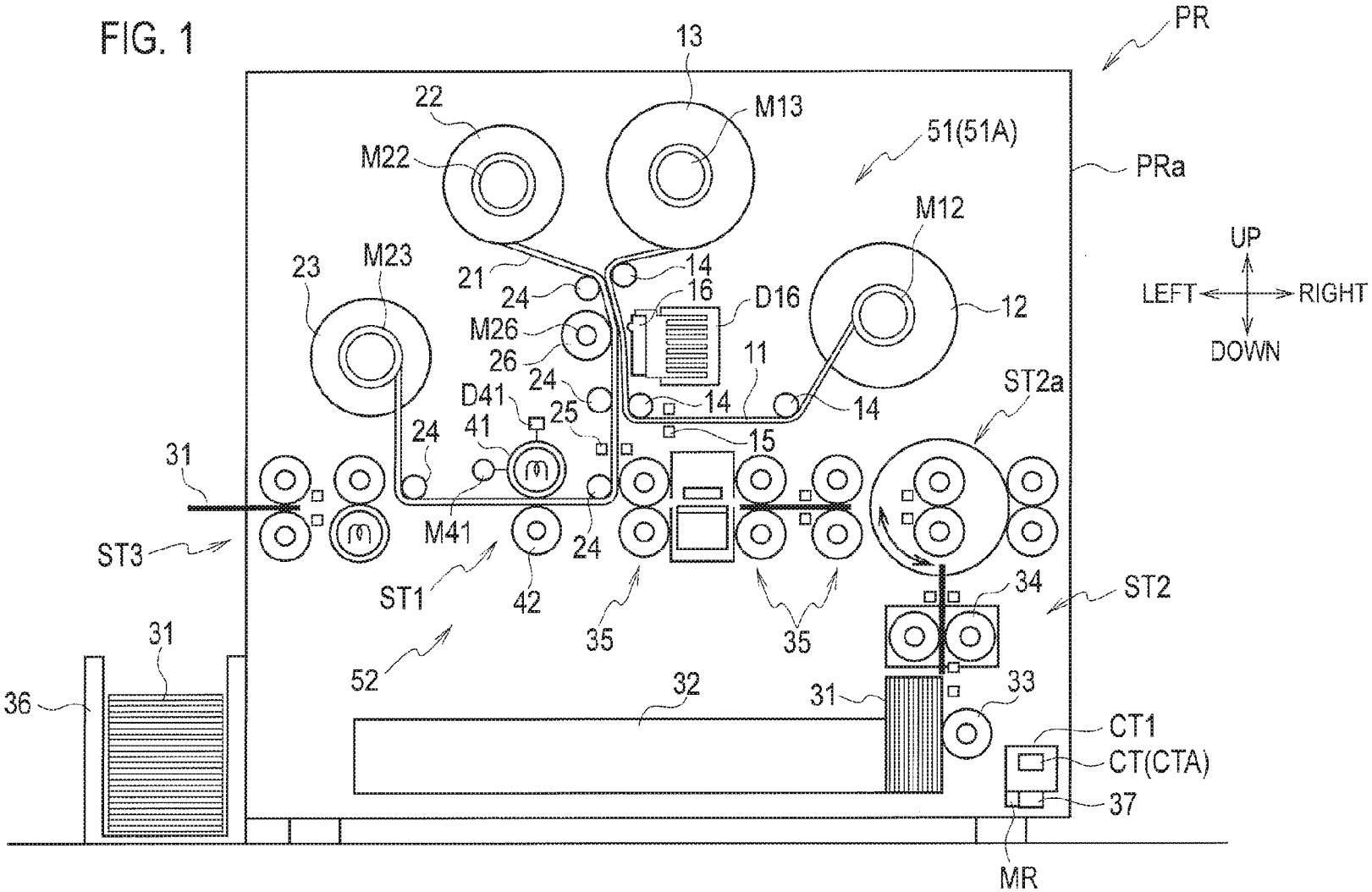
FIG. 1 is a diagram for explaining a printing apparatus PR of a re-transfer scheme containing an image formation apparatus 51 which is an example of an image formation apparatus according to one embodiment of the present invention.
Figure 2:
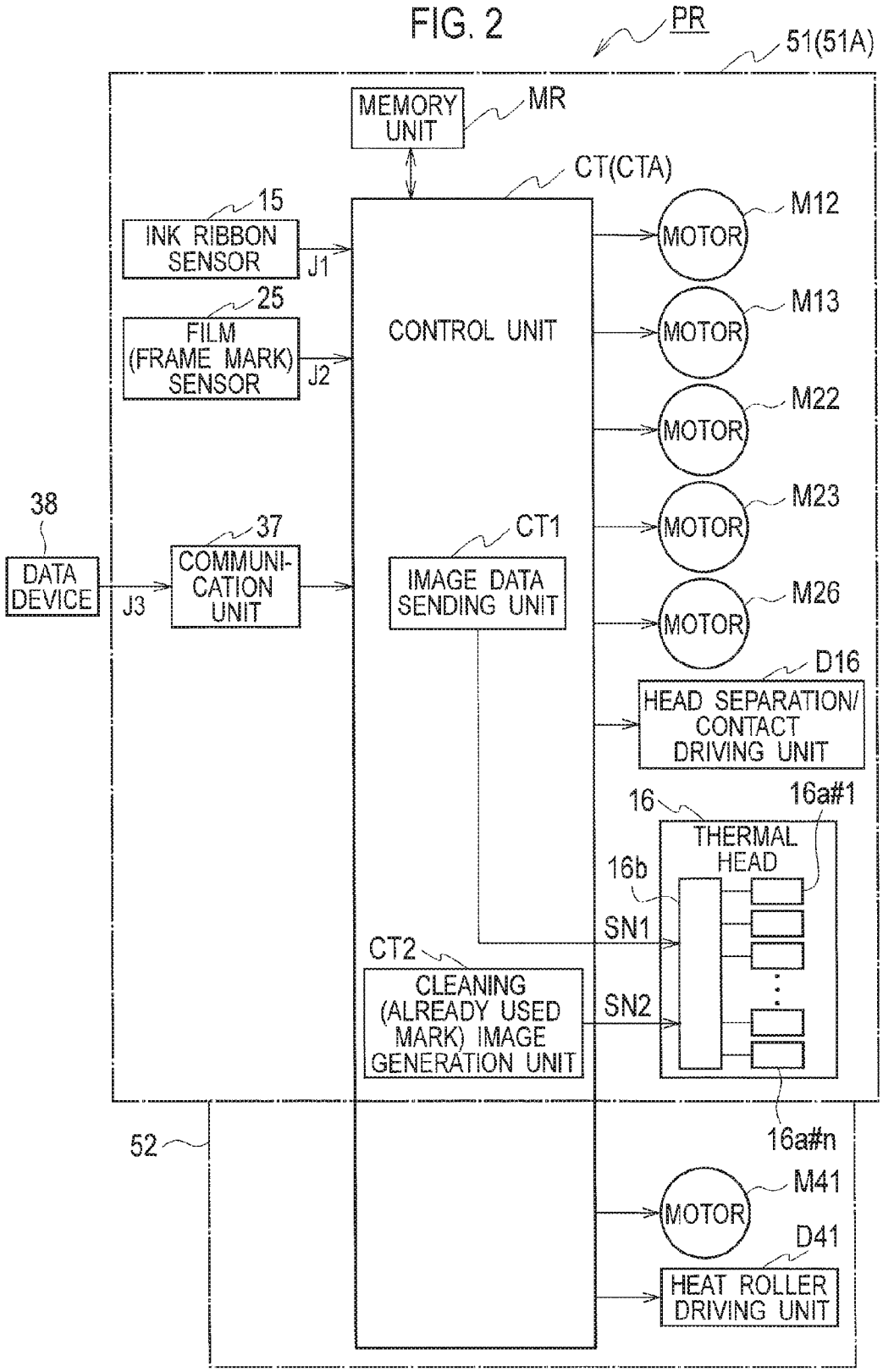
FIG. 2 is a block diagram for explaining a configuration of the printing apparatus PR.

As shown in FIG. 1, the image formation apparatus 51 is housed inside a casing PRa of the printing apparatus PR. The printing apparatus PR is a printing apparatus of a re-transfer scheme, which is the so-called card printer.

The image formation apparatus 51 is freely detachably attachable with a supply reel 12 and a winding reel 13 for an ink ribbon 11.

The supply reel 12 and the winding reel 13 that have been attached are rotated by driving a motor M12 and a motor M13 for driving respectively. Rotational speeds and rotational directions of the motors M12, M13 are controlled by a control unit CT that is provided on the image formation apparatus 51.

The ink ribbon 11 is bridged over a prescribed running route as being guided by a plurality of guide shafts 14, between the supply reel 12 and the winding reel 13.

An ink ribbon sensor 15 for cueing is arranged on a course of the running route of the ink ribbon 11.

The ink ribbon sensor 15 detects a cueing mark 11*d* of the ink ribbon 11 (see FIG. 3), and sends out a ribbon mark detection information J1 (see FIG. 2) toward the control unit CT.

A thermal head 16 is arranged between the ink ribbon sensor 15 and the winding reel 13 in the running route of the ink ribbon 11.

Figure 5:
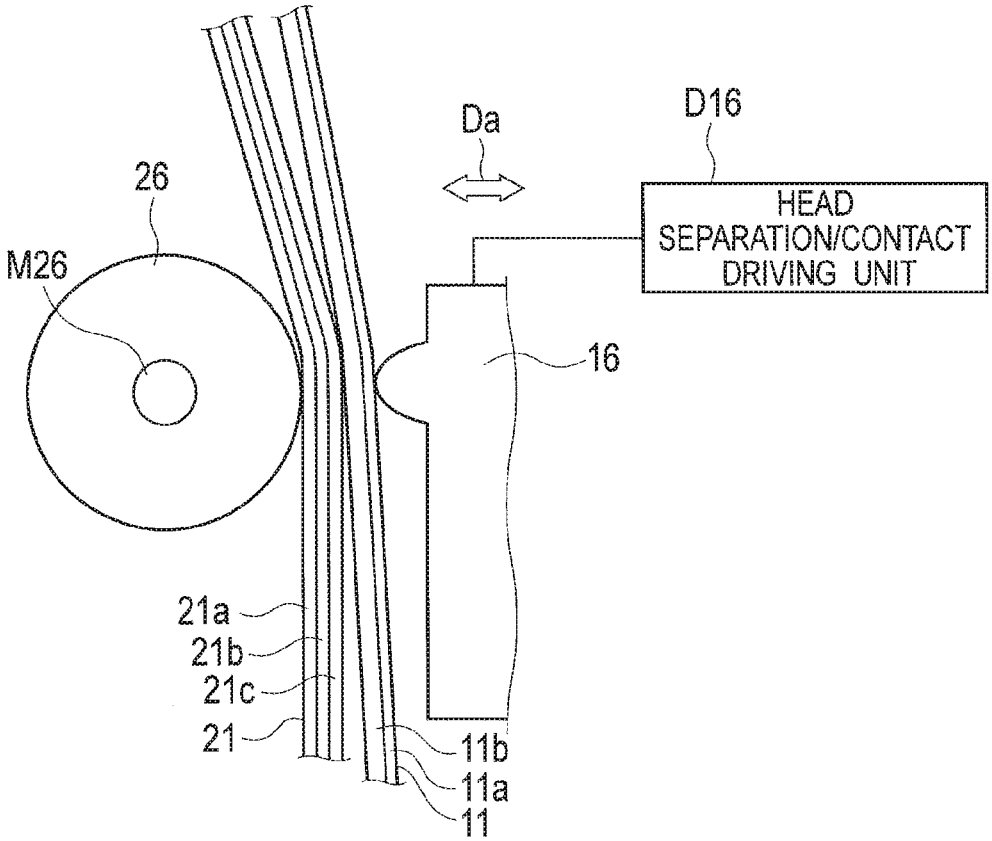
FIG. 5 is a schematic diagram for explaining a pressed contact state of a thermal head 16 in the image formation apparatus 51.

The thermal head 16 is separated/contacted with respect to a face on a ribbon base 11*a* side of the ink ribbon 11 that is bridged over (an arrow Da direction in FIG. 5).

This separation/contact operation of the thermal head 16 is carried out by a head separation/contact driving unit D16 under the control of the control unit CT.

The image formation apparatus 51 is freely detachably attachable with a supply reel 22 and a winding reel 23 for an intermediate transfer film 21, on left side of FIG. 1 with respect to the installed ink ribbon 11.

The supply reel 22 and the winding reel 23 that have been attached are rotated by driving a motor M22 and a motor 23 for driving respectively. Rotational speeds and rotational directions of the motors M22, M23 are controlled by the control unit CT.

The intermediate transfer film 21 is bridged over a prescribed running route as being guided by a plurality of guide shafts 24, between the supply reel 22 and the winding reel 23.

A film sensor 25 for cueing is arranged on a course of the running route of the intermediate transfer film 21.

The film sensor 25 detects a frame mark 21*d* of the intermediate transfer film 21 (see FIG. 4), and sends out a frame mark detection information J2 (see FIG. 2) toward the control unit CT.

A platen roller 26 that is rotated by driving a motor M26 is arranged between the film sensor 25 and the supply reel 22 in the running route of the intermediate transfer film 21.

A rotational speed and a rotational direction of the motor M26 are controlled by the control unit CT.

As also shown in FIG. 5, the thermal head 16 is separated/contacted with respect to the ink ribbon 11 by a separation/contact operation of the head separation/contact driving unit D16.

More specifically, the thermal head 16 presses the ink ribbon 11 toward the platen roller 26, and moves between a pressed contact position (a position shown in FIG. 5) at which the intermediate transfer film 21 and the ink ribbon 11 are held and put into pressed contact between the thermal head 16 and the platen roller 26 and a separated position (a position shown in FIG. 1) at which the thermal head 16 is separated from the ink ribbon 11. When the thermal head 16 is in the pressed contact position, the transfer to be described below will be carried out.

The ink ribbon 11 and the intermediate transfer film 21 are made such that the winding to the winding reel 13, 23 side and the rewinding to the supply reel 12, 22 side can be respectively carried out independently, by the operations of the motors M12, M13 and the motors M22, M23 respectively, in a state where the thermal head 16 is in the separated position.

The ink ribbon 11 and the intermediate transfer film 21 are made such that they are movable to the supply reel side or the winding reel side while in close contact with each other, in a state where the thermal head 16 is in the pressed contact position. This movement is carried out by the rotations of the supply reels 12, 22, the winding reels 13, 23 and the platen roller 26 by driving the motors M12, M13, M22, M23 and M26, under the control of the control unit CT.

The control unit CT has an image data sending unit CT1 and a cleaning image generation unit CT2.

The image data sending unit CT1 supplies image data SN1 to be transferred respectively to transfer frames F (to be described later) of the intermediate transfer film 21, to the thermal head 16 at appropriate timing, when the thermal head 16 is in the pressed contact position. This timing is determined by the control unit CT as a whole according to the frame mark detection information J2 and the like. The image data sending unit CT1 generates the image data SN1 according to a transfer image information J3.

The cleaning image generation unit CT2 generates a control signal (hereafter referred to as a C transfer control signal SN2) for transferring a cleaning image for removing lubricants attached and deposited on heating resistors 16*a*, and supplies the C transfer control signal SN2 to the thermal head 16 at appropriate timing, for each transfer frame. This timing is determined by the control unit CT as a whole to be appropriate time with respect to the identical frame, after supplying the image data SN1 from the image data sending unit CT1.

Figure 3A:
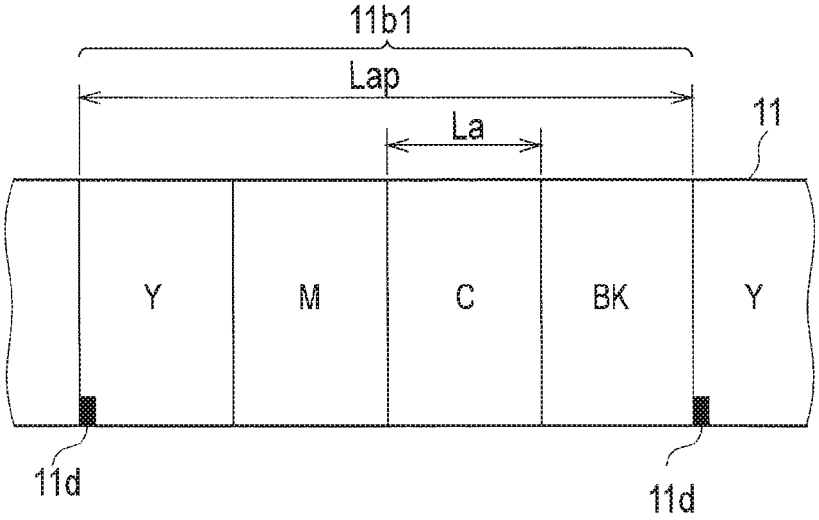
FIGS. 3A and 3B are diagrams for explaining an ink ribbon 11 to be used in the image formation apparatus 51.
Figure 3B:
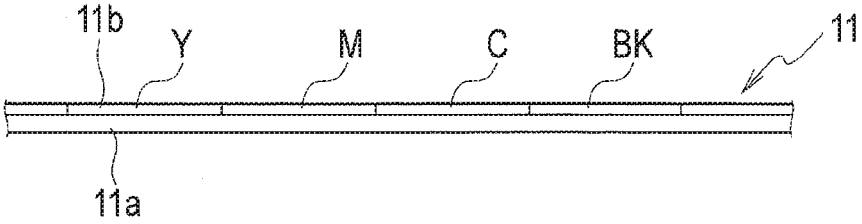

As shown in FIGS. 3A and 3B, the ink ribbon 11 has a ribbon shaped ribbon base 11*a*, and an ink layer 11*b* formed by application on the ribbon base 11*a*.

The ink layer 11*b* is formed by repeatedly applying an ink set 11*b*1 that is a set of ink layers of a plurality of colors (four colors here) arranged in a ribbon direction.

The ink set 11*b*1 comprises a yellow ink layer Y, a magenta ink layer M, a cyan ink layer C, and a black ink layer BK, which are applied in the ribbon direction in this order.

The ink of each color is of the sublimation type. There are cases in which the melting type is used for the black.

A cueing mark 11*d* is formed on one edge part of a boundary portion with the adjacent black ink layer BK in the yellow ink layer Y.

A length La in the ribbon direction of each ink layer Y, M, C and BK is the same each other. Consequently, a pitch Lap of the set of the ink layers 11*b* is set to be four times the length La.

A position of the ink ribbon sensor 15 is set such that the pressed contact position of the thermal head 16 coincides with a position of a leading edge in a running direction of the yellow ink layer Y, when the ink ribbon sensor 15 detects the cueing mark 11*d*.

Namely, a running route length from the pressed contact position to a detection position of the ink ribbon sensor 15 is set to be an integer multiple of the pitch Lap.

Figure 4A:
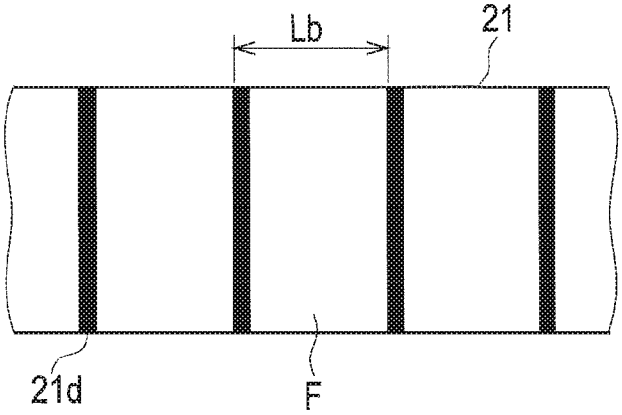
FIGS. 4A and 4B are diagrams for explaining an intermediate transfer film 21 to be used in the image formation apparatus 51.
Figure 4B:
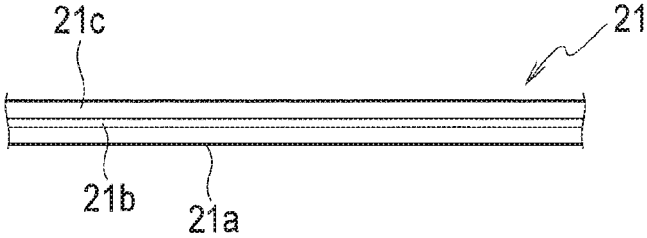

As shown in FIGS. 4A and 4B, the intermediate transfer film 21 has a ribbon shaped film base 21*a*, and a peeling layer 21*b* and a transfer image receiving layer 21*c*, which are formed by lamination on the film base 21*a*.

A width of the film base 21*a* is the same as a width of the ribbon base 11*a* of the ink ribbon 11.

A frame mark 21*d* is repeatedly formed at a prescribed pitch Lb in the ribbon direction, on the film base 21*a* or the transfer image receiving layer 21*c*.

The frame mark 21*d* is formed over an entire width.

The pitch Lb is the same as the length La in the ink ribbon 11 (La=Lb).

Regions partitioned at the pitch Lb in the intermediate transfer film 21 are transfer frames F. Hereafter the transfer frame F is referred to simply as a frame F. Namely, the frame mark 21*d* is assigned to a border portion of each frame F, and partitions each frame F.

A position of the film sensor 25 is set such that the pressed contact position of the thermal head 16 coincides with a position of a leading edge in a running direction of the frame mark 21*d*, when the film sensor 25 detects the frame mark 21*d*.

Namely, a running route length from the pressed contact position to a detection position of the film sensor 25 is set to be an integer multiple of the pitch Lb.

In the image formation apparatus 51, the intermediate transfer film 21 and the ink ribbon 11 are bridged over as shown in FIG. 5, in orientations in which the transfer image receiving layer 21*c* and the ink layer 11*b* are directly facing each other.

The transfer image receiving layer 21*c* has a property for receiving and fixing the ink of the ink layer 11*b* that is sublimated by heating. In the case where the ink of the black ink layer BK is of the melting type, the transfer image receiving layer 21*c* receives and fixes the black ink that is melted by heating.

In this way, in the pressed contact state of the thermal head 16 as shown in FIG. 5, the ink from the ink layer 11*b* that is in pressed contact with the transfer image receiving layer 21*c* is transferred, and an image is formed on the transfer image receiving layer 21*c*. The ink is transferred in a heating pattern according to the image data SN1 supplied to the thermal head 16.

The image formation apparatus 51 described in detail above is made such that the ink ribbon 11 and the intermediate transfer film 21 that are set by a user can be moved while being in close contact by the pressing of the thermal head 16.

Figure 6:
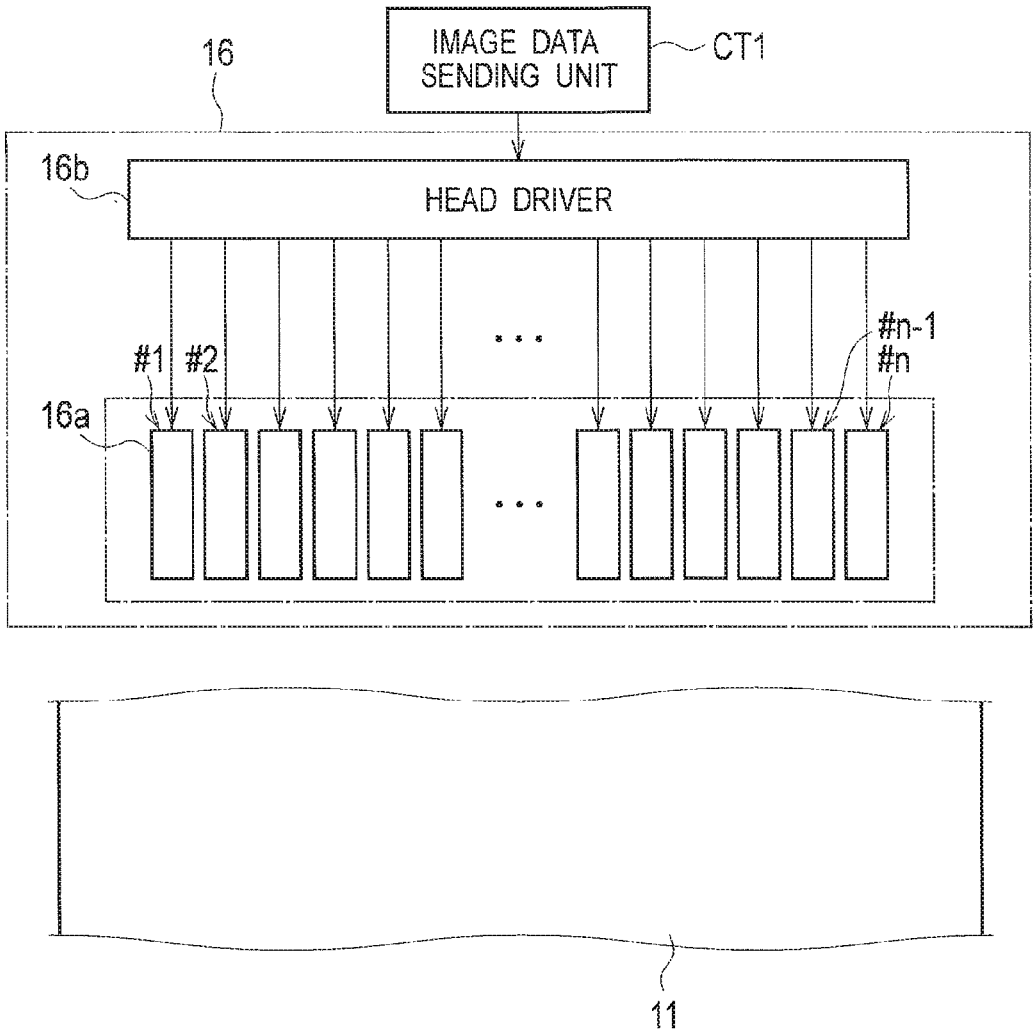
FIG. 6 is a schematic diagram for explaining the thermal head 16.

As shown in FIG. 6, the thermal head 16 has n sets of heating resistors 16*a* (n is an integer greater than or equal to 2) from #1 to #n that are arranged and aligned in a width direction of the ink ribbon 11. Also, the thermal head 16 has head drivers 16*b* for conducting electricity independently to respective one of the plurality of heating resistors 16*a*, according to the image data SN1 and the C transfer control signal SN2.

The heating resistors 16*a* are arranged to be 300 sets per one inch, for example.

The head drivers 16*b* carry out the electricity conduction with respect to respective one of the plurality of the heating resistors 16*a*, based on the image data SN1 to be transferred that is sent out from the image data sending unit CT1 and the C transfer control signal SN2 that is sent out from the cleaning image generation unit CT2.

Usually, the heating resistors 16*a* that correspond to the image to be formed are not all the heating resistors 16*a* in a total number n, and set to be neighboring m sets (m is an integer greater than or equal to 1 for which m<n) with margins on both ends in the arranging direction. Namely, among the plurality of the heating resistors 16*a* that are arranged, (n−m) sets are not used for the image formation, as margins. Also, the m sets of the heating resistors 16*a* are selected to be consecutive m sets excluding heating resistors of at least one end among the n sets.

Consequently, when a number of lines in the ribbon direction (longitudinal) of the image to be transferred (corresponding to a number for which the ON and OFF of the electricity conduction can be selected) is set as a number of line LNa, the image is formed by width×longitudinal=m×LNa dots, on the intermediate transfer film 21 which is the image formation target object.

For example, as the printing apparatus PR, in the case of forming the image of 300 dpi on the card of outer dimensions 86 mm×54 mm which is a re-transfer target object, m is set to be approximately 1000 and a value of LNa is set to be approximately 600.

The image formation apparatus 51 makes the transfer of the ink of the ink layer 11*b* of the ink ribbon 11 to the transfer image receiving layer 21*c* of the intermediate transfer film 21, by appropriately heating respective heating resistors 16*a* of the thermal head 16, according to the image data to be transferred, while moving the ink ribbon 11 and the intermediate transfer film 21 in close contact.

In this way, a desired image can be transferred and formed on a frame of the transfer image receiving layer 21*c*. Details of this image formation operation will be described later.

Returning to FIG. 1, the printing apparatus PR has a re-transfer apparatus (or a re-transfer unit) 52 for re-transferring a part of the image formed on the transfer image receiving layer 21*c* (hereafter also referred to as an intermediate image P) of the intermediate transfer film 21 which is the image formation target object by the image formation apparatus 51, to a further transfer target object.

Here, a further transfer target object is a card 31. In FIG. 1, the card 31 during a transportation is indicated by a thick solid line.

The re-transfer apparatus 52 shares the control unit CT with the image formation apparatus 51.

The re-transfer apparatus 52 has a re-transfer unit ST1 provided between the platen roller 26 and the winding reel 23 in the running route of the intermediate transfer film 21, a feeding unit ST2 for feeding the card 31 to the re-transfer unit ST1, and a take out unit ST3 for taking out the card 31 that passed the re-transfer unit ST1.

The re-transfer unit ST1 has a heat roller 41 that is rotated by a motor M41, an opposing roller 42 that is arranged opposite to the heat roller 41, and a heat roller driving unit D41 for separating/contacting the heat roller 41 with respect to the opposing roller 42.

The feeding unit ST2 has a posture conversion unit ST2*a* for rotating a posture of the card 31 by 90° such that it is converted from vertical to horizontal, while holding the card 31.

The feeding unit ST2 further has a lifting roller 33 for rotating to lift the rightmost one in FIG. 1 upward, among the plurality of cards 31 that are loaded in the standing postures at a stacker 32.

The feeding unit ST2 also further has a pair of feeding rollers 34 for holding and feeding the card 31 lifted by the lifting roller 33 to the posture conversion unit ST2*a* arranged on an upper side, and a plurality of pairs of transporting rollers 35 for transporting the card 31 that is converted into a horizontal posture by the posture conversion unit ST2*a* to the re-transfer unit ST1 on a left side.

An operation of the motor M41 is controlled by the control unit CT. Also, the lifting roller 33, the feeding rollers 34, and the transporting rollers 35 are rotated by driving motors not shown in the figure, respectively under the control of the control unit CT.

The re-transfer apparatus 52 converts one card 31 that is taken out to an upper side in the vertical posture from the stacker 32 in the feeding unit ST2 to the horizontal posture at the posture conversion unit ST2*a*, and transports and supplies this card 31 to the re-transfer unit ST1.

In the re-transfer unit ST1, the card 31 moves toward the take out unit ST3 by driving the motor M41, while being in pressed contact and held with the intermediate transfer film 21 between the temperature increased heat roller 41 and the opposing roller 42, by the operation of the heat roller driving unit D41. To the card 31, the transfer image receiving layer 21*c* of the intermediate transfer film 21 is put in pressed contact.

With this pressed contact moving, a range of a part of the intermediate image P formed on the transfer image receiving layer 21*c* by the image formation apparatus 51 is transferred to the card 31. Namely, the image Pc is formed by the re-transfer on a surface of the card 31.

The card 31 with the image Pc re-transferred and formed thereon is transported to the take out unit ST3, and accumulated and stored in an external stocker 36, for example.

The image formation apparatus 51 has a memory unit MR and a communication unit 37, along with the control unit CT. The memory unit MR stores in advance an operation program for carrying out the operation of the printing apparatus PR as a whole including the image formation apparatus 51, a transfer image information J3 that is an information of the image to be transferred, and the like. The memory contents of the memory unit MR are appropriately referred by the control unit CT.

The operation program and the transfer image information J3 are supplied to the control unit CT via the communication unit 37 from an external data device 38 and the like (see FIG. 2), and stored in the memory unit MR.

Next, the image formation operation and method with respect to the intermediate transfer film 21 by the image formation apparatus 51 will be described with references to FIG. 7 to FIG. 15.

The image formation apparatus 51 carries out a rewinding operation and a cueing operation in each of the transfer operation for four colors.

First, a procedure for transferring and forming the image P(1) on the frame F1, which is the first frame on which the image is to be formed, in the intermediate transfer film 21, will be described with references mainly to FIG. 7 to FIG. 9.

Figure 7:
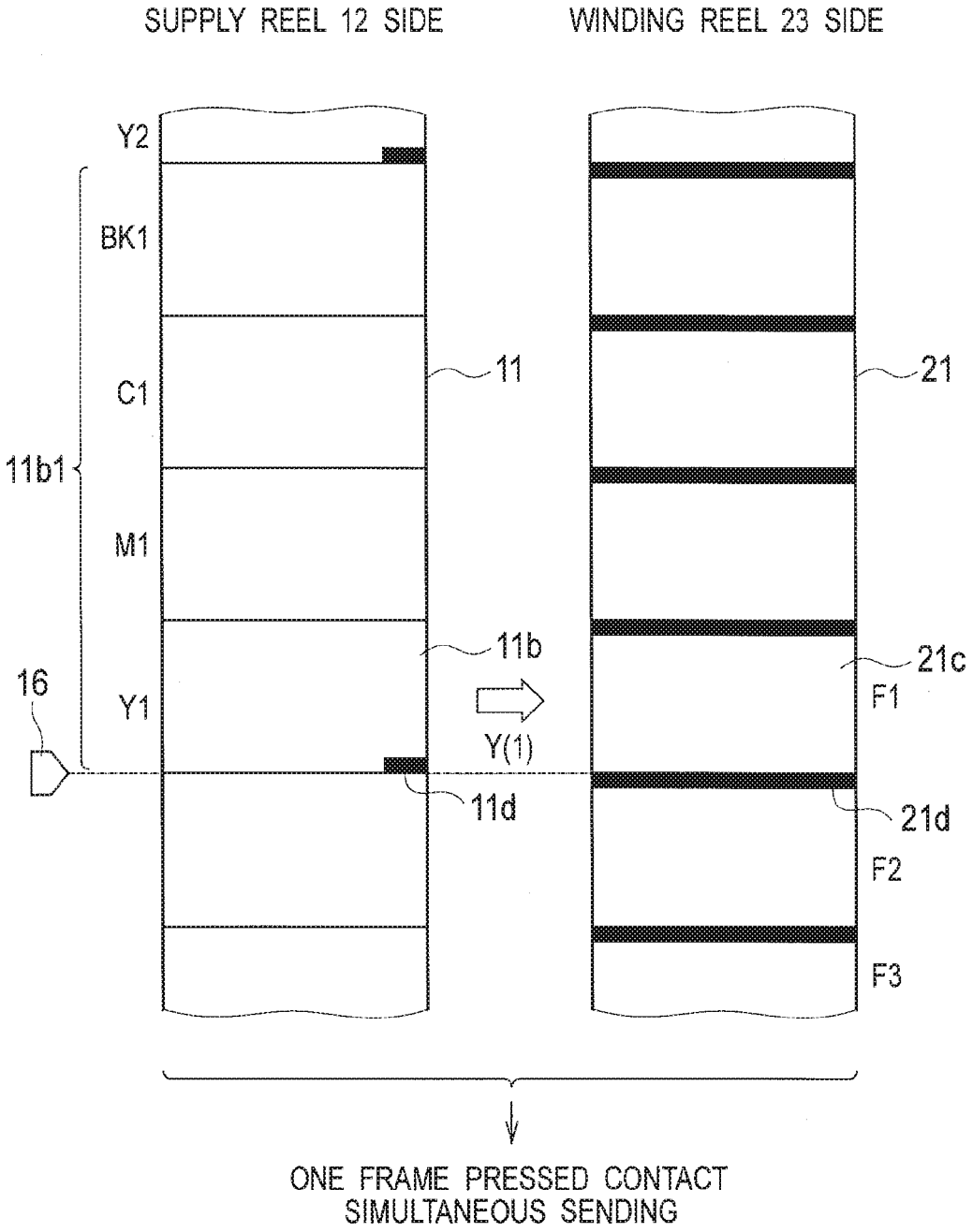
FIG. 7 is a diagram for explaining a cueing and transfer operation in a transfer between the ink ribbon 11 and the intermediate transfer film 21.
Figure 8:
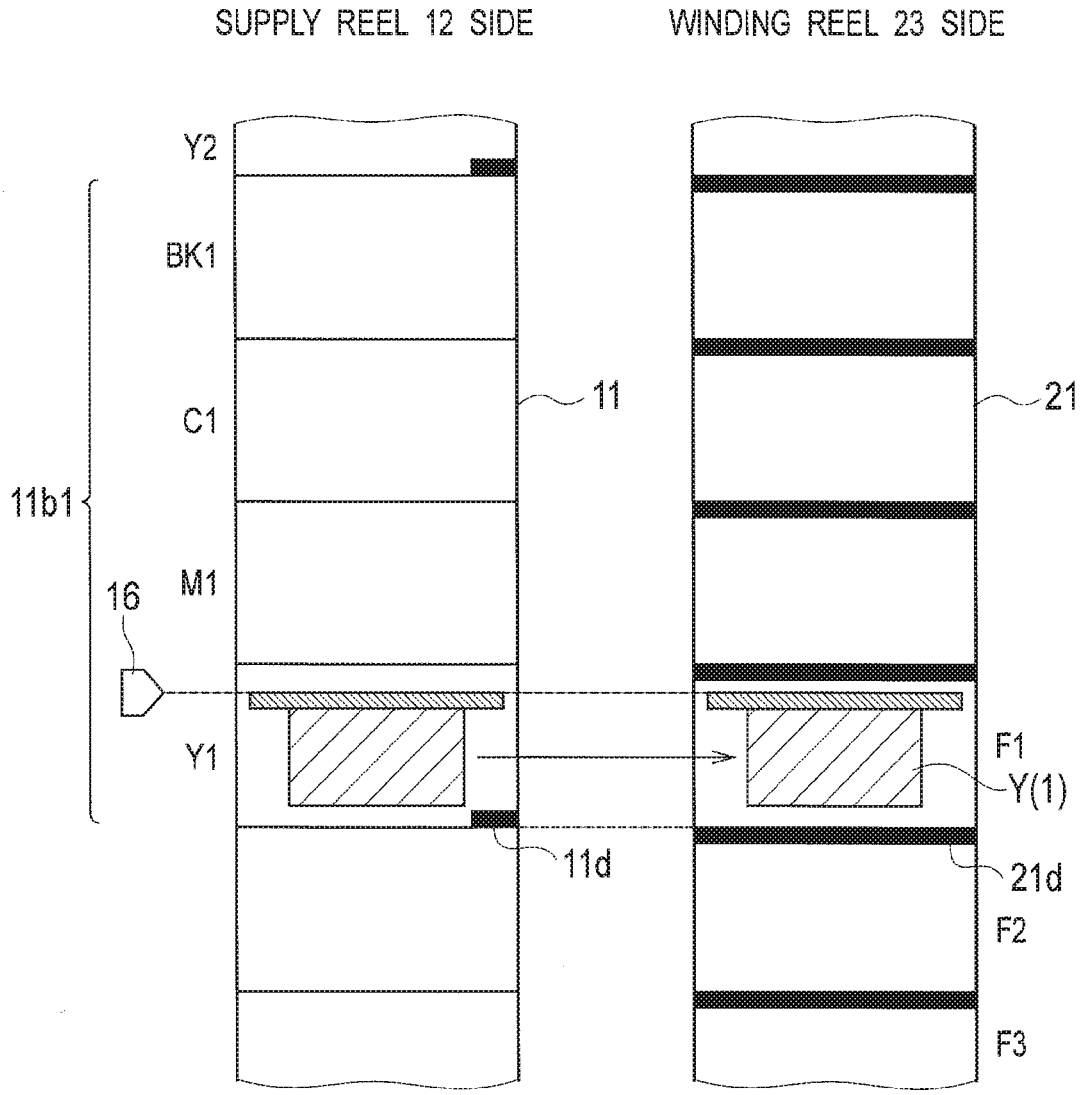
FIG. 8 is a diagram for explaining a transfer of ink of an ink layer Y1 in the ink ribbon 11 to a frame F1 in the intermediate transfer film 21.

In FIG. 7 and FIG. 8, positions and transfer contents of the ink ribbon 11 and the intermediate transfer film 21 with respect to the thermal head 16 that is not moving in a moving direction of the ink ribbon 11 (whose position is determined) are shown. Also, a face of the ink layer 11*b* on the ink ribbon 11 and the transfer image receiving layer 21*c* on the intermediate transfer layer 21 which are facing each other in close contact in the transfer operation are shown to be arranged in left and right.

Also, in FIG. 7 and FIG. 8, the ink sets 11*b*1 to be provided for the transfer are assigned with serial numbers starting from 1 for the sake of explanation. For example, Y1 to BK1 indicates the yellow ink layer to the black ink layer of the first set.

Also, for the frame F, serial numbers are assigned in the order of frames on which the image is to be transferred and formed. For example, F3 indicate a third frame on which the image is to be transferred and formed.

Also, the images to be transferred are indicated with serial numbers within parentheses ( ). For example, the image M(1) means the first image (an image to be formed on the frame F1) to be transferred with the magenta ink. Similarly, the image C(1) means the first image (an image to be formed on the frame F1) to be transferred with the cyan ink.

Figure 9:
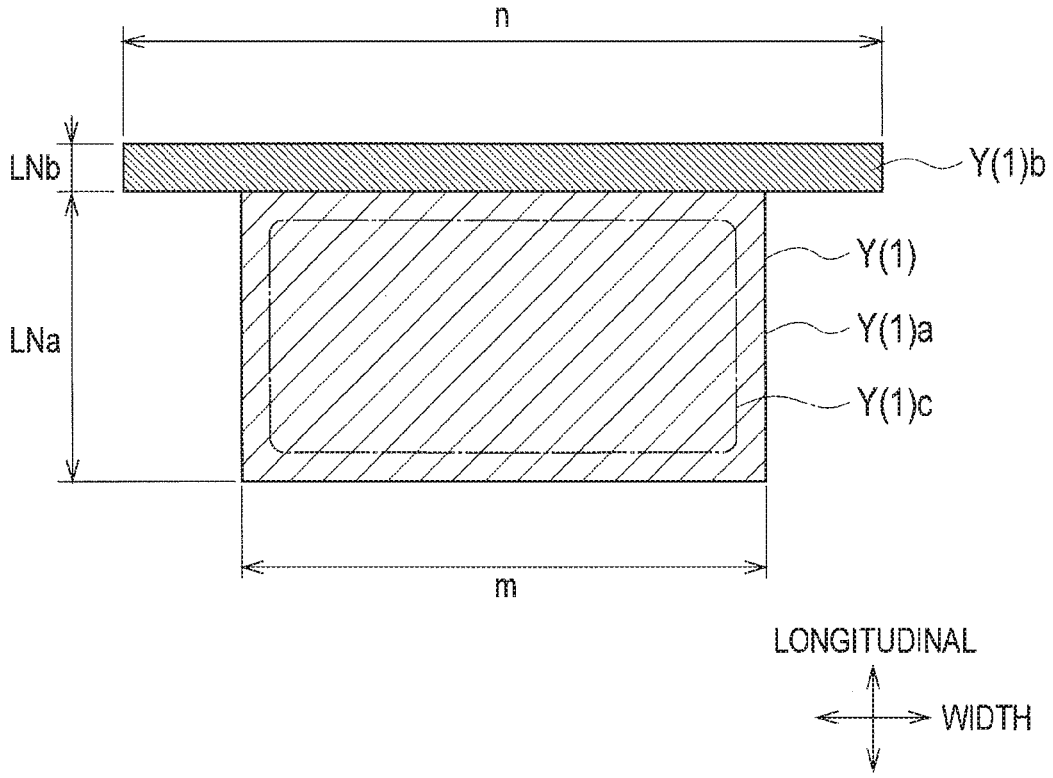
FIG. 9 is a diagram for explaining an image Y(1) that is transferred to the frame F1.

FIG. 9 is a diagram in which the image Y(1) that has been transferred and formed on the intermediate transfer film 21 is extracted for the sake of explanation.

First, as shown in FIG. 7, the alignment of the yellow ink layer Y1 and the frame F1 is carried out by the cueing operation.

Next, the image Y(1) is transferred on the frame F1 with the ink of the yellow ink layer Y1, while moving the ink ribbon 11 and the intermediate transfer film 21 in close contact to a lower side of FIG. 7 with the thermal head 16 put in the pressed contact state.

This close contact moving is for one frame part. A sending direction is a winding direction (forward feeding) for the ink ribbon 11 and a rewinding direction (backward feeding) for the intermediate transfer film 21.

FIG. 8 shows the image Y(1) in a state of having the transfer finished.

On the frame F1 of the intermediate transfer film 21, the image Y(1) of the yellow ink has been transferred and formed. Also, the ink layer Y1 on the ink ribbon 11 has been in a state where the ink in a range (indicated as shaded) corresponding to the image Y(1) is less than other ranges or completely absent.

As shown in FIG. 9, the image Y(1) is formed by two ranges. Namely, these are a rectangular range Y(1)*a* in which the width direction is corresponding to the m sets of the heating resistors 16*a* while the longitudinal direction is corresponding to the number of lines LNa, and a thin rectangular range Y(1)*b* in which the width direction is corresponding to the n sets of the heating resistors 16*a* which are extending out from both sides of the range Y(1)*a* while the longitudinal direction is corresponding to the number of lines LNb which is less than the number of lines LNa.

The range Y(1)*b* is transferred after the range Y(1)*a* is transferred.

In this example, the range Y(1)*a* and the range Y(1)*b* are transferred and formed continuously, but they may be transferred and formed with a separation in the longitudinal direction.

A re-transfer range Y(1)*c* to be re-transferred on a re-transfer target object by the re-transfer apparatus 52 is smaller than the range Y(1)*a*, and made to be completely contained inside the range Y(1)*a* in both the longitudinal direction and the width direction.

Details such as the transfer density D and the number of lines LNb in the transfer of the range Y(1)*b* will be described later.

As shown in FIG. 8, to the frame F1 on which the image Y(1) has been transferred with the ink of the yellow ink layer Y1, the image M(1) is to be transferred in superposition with the ink of the magenta ink layer M1 next.

Figure 10:
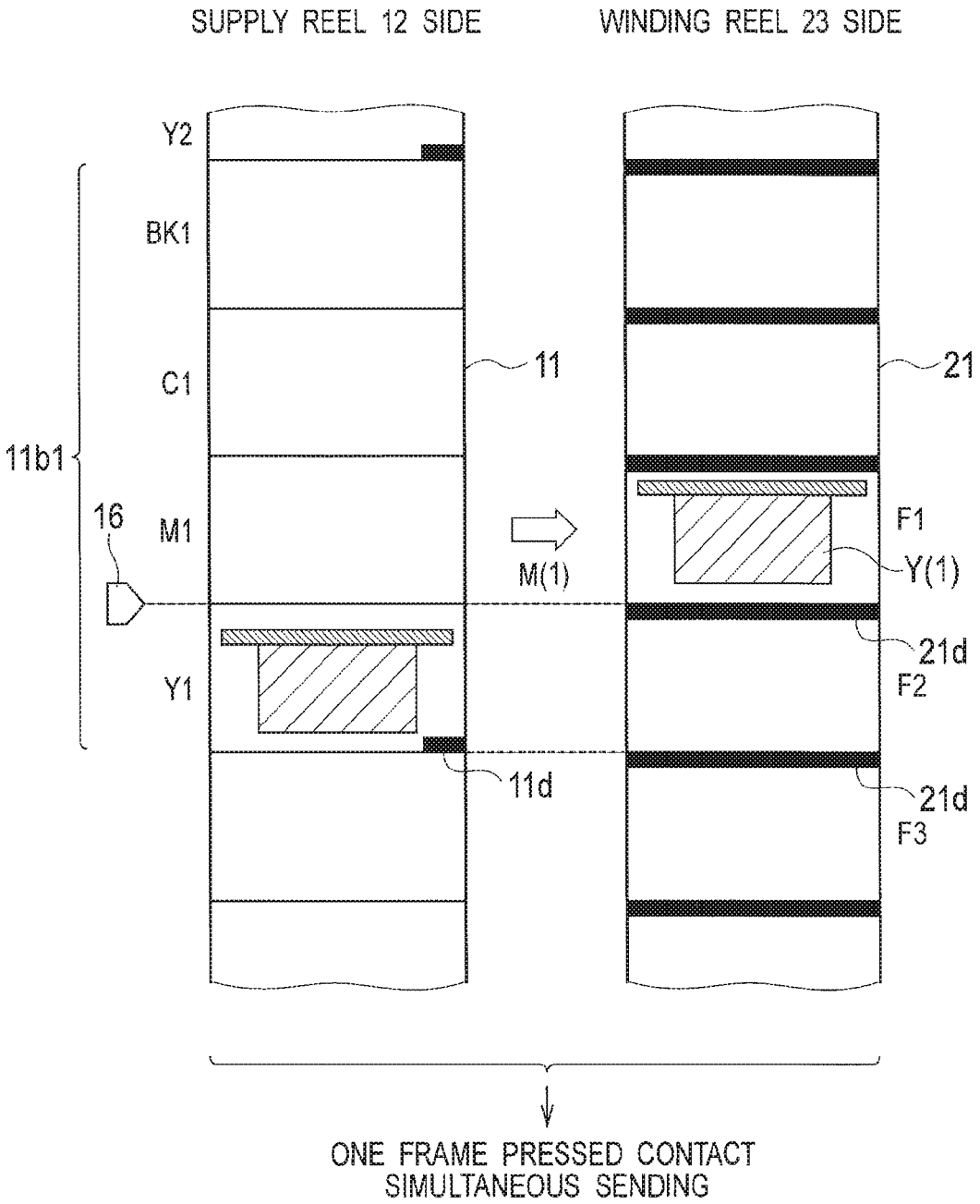
FIG. 10 is a diagram for explaining a superposed transfer of ink of an ink layer M1 in the ink ribbon 11 to the frame F1.

First, as shown in FIG. 10, the alignment of the magenta ink layer M1 and the frame F1 is carried out by the cueing operation. In this cueing operation, the thermal head 16 is set to be in the separated position that is separated from the ink ribbon 11, the ink ribbon 11 is sent out (forward feeding) to a lower side from a state of FIG. 8, and the intermediate transfer film 21 is rewound (forward feeding) to an upper side from a state of FIG. 8.

Next, the image M(1) is transferred on the frame F1 with the ink of the magenta ink layer M1, while moving the ink ribbon 11 and the intermediate transfer film 21 in close contact to a lower side of FIG. 10 with the thermal head 16 put in the pressed contact state.

Here, for the sake of ease in understanding, it is assumed that shapes and ranges of the image Y(1) and the image M(1) are the same. Namely, the image M(1) comprises a range M(1)*a* of m×LNa which is identical to the range Y(1)*a*, and a range M(1)*b* of a thin rectangular shape which is identical to the range Y(1)*b*.

Figure 11:
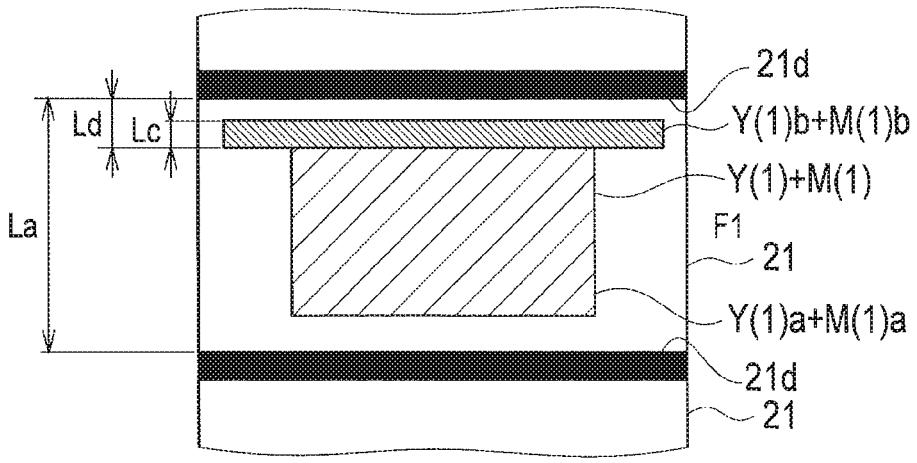
FIG. 11 is a diagram for explaining a transferred image of the frame F1 that is formed by the superposed transfer of ink of the ink layer Y1 and the ink layer M1.

In this way, the image in which the image Y(1) and the image M(1) are superposed as shown in FIG. 11 is obtained on the frame F1.

Also, the range M(1)*a* is superposed over the range Y(1)*a*, and the range M(1)*b* is superposed over the range Y(1)*b*.

Similarly, the image C(1) and the image BK(1) of the same shape and range as the image Y(1) are transferred on the frame F1 sequentially, from the cyan ink layer C1 and the black ink layer BK1 respectively.

Figure 12:
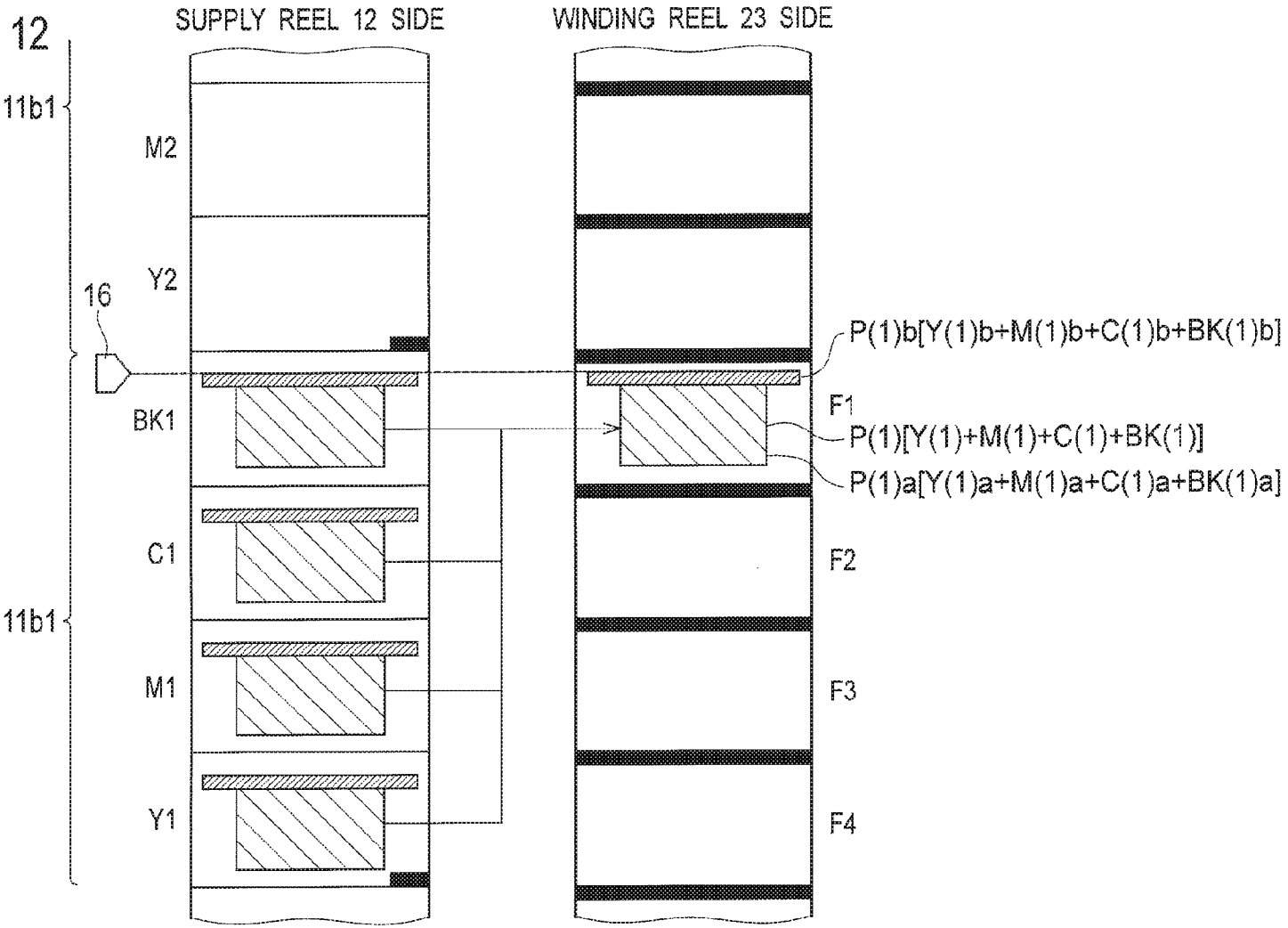
FIG. 12 is a diagram for explaining an image P(1) that is formed on the frame F1.

FIG. 12 shows the image BK(1) of the fourth color in a state of having the transfer finished.

Namely, on the frame F1, the image P(1) has been formed as the intermediate image P as the image Y(1), the image M(1), the image C(1) and the image BK(1) have been transferred in superposition.

In the image P(1), the range P(1)*a* is formed by superposing the range Y(1)*a*, the range M(1)*a*, the range C(1)*a* and the range BK(1)*a*, and the range P(1)*b* is formed by superposing the range Y(1)*b*, the range M(1)*b*, the range C(1)*b* and the range BK(1)*b*.

As such, the image P(1) is formed by including the image of the range P(1)*a* and the image of the range P(1)*b*. The range P(1)*a* is the image that is transferred and formed according to the image data SN1 supplied from the image data sending unit CT1, and the range P(1)*b* is the image for cleaning that is transferred and formed according to the C transfer control signal SN2 generated at the cleaning image generation unit CT2.

On the frame F2 and subsequent frames, the image P(2) and subsequent images can be formed similarly as the frame F1.

Then, a part of the intermediate image P formed on each frame P is transferred as the image Pc on the card 31, by the re-transfer apparatus 52.

Figure 13:
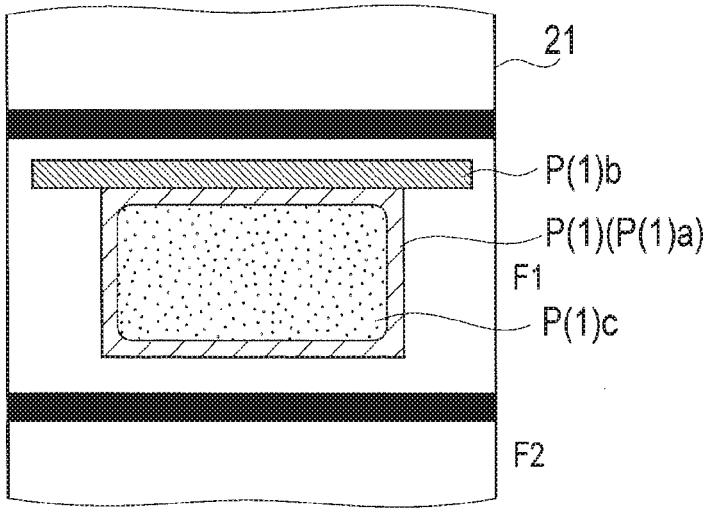
FIG. 13 is a diagram for explaining a state after a re-transfer of the image P(1) that is formed on the frame F1.

FIG. 13 shows a state after re-transferring the image P(1) that has been formed on the frame F1 in the intermediate transfer film 21, as shown in FIG. 12, to the card 31.

A part of the range P(1)*a* of the image P(1) is transferred to the card 31 to become the re-transfer range P(1)*c*.

Consequently, there is no influence on the re-transfer image on the card 31 even when the range P(1)*b* is provided.

The image formation apparatus 51 can remove the attached substances such as lubricants that have attached and deposited on the heating resistors 16*a* of the thermal head 16, by forming the image P(1) that is the intermediate image to be formed on the frame F1, by including the range P(1)*b* in which the range Y(1)*b* to the range BK(1)*b* described above are superposed, in addition to the range P(1)*a* that includes the range to be re-transferred.

In the following, the transfer of each of the range Y(1)*b* to the range BK(1)*b* will also be referred to as a cleaning transfer CP.

A condition under which the removal of the attached substances can be carried out well at a time of carrying out the cleaning transfer CP will be explained for a representative example of the cleaning transfer CP in the yellow ink layer Y1.

First, the transfer density D and the number of lines LNb of the range Y(1)*b* to be transferred by the cleaning transfer CP will be explained.

Figure 14:
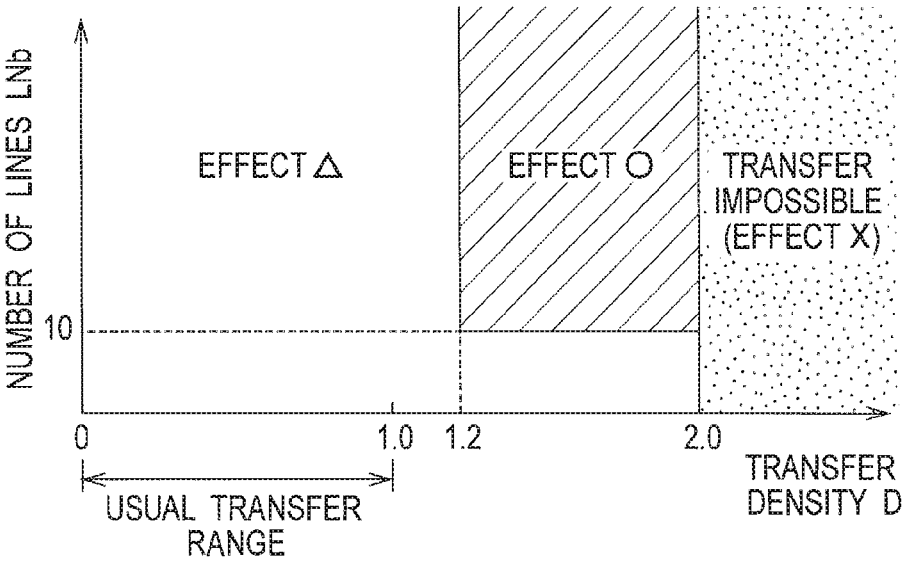
FIG. 14 is a figure showing a relationship among a transfer density D, a number of lines LNb, and an effect of removing attached substances in a transfer operation of the image formation apparatus 51.

FIG. 14 is a figure showing the transfer density D and the number of lines LNb of the range Y(1)*b* and the effect of removing the attached substances, when the transfer density of the range Y(1)*a* to be transferred is set in a range of the lowest 0 to the highest 1.0. A value of the number of lines LNa of the range Y(1)*a* is set to be 600. Also, the number of lines LNb is assumed to be greater than or equal to 1.

As shown in FIG. 14, the effect of removing the attached substances depends on the transfer density D and the number of lines LNb.

Details are as follows.

With the transfer density less than 1.2, regardless of the number of lines LNb, there are many cases that are only removing partially. Consequently, it is judged that it is hard to obtain a good removing effect stably (a white section: effect indicated by triangle).

In the case where the transfer density D is greater than or equal to 1.2 and less than or equal to 2.0 and the number of lines LNb is less than 10, there are some cases in which the attached substances can be removed almost completely, but it is nor sure. Consequently, it is judged that it is hard to obtain a good removing effect stably (a white section: effect indicated by triangle).

In the case where the transfer density D is greater than or equal to 1.2 and less than or equal to 2.0 and the number of lines LNb is greater than or equal to 10, the attached substances are stably removed almost completely so that a good removing effect can be recognized (a hatched section: effect indicated by circle).

In the case where the transfer density is greater than or equal to 2.0, there are many cases in which the ink ribbon 11 and the intermediate transfer film 21 are welded, so that it is judged as transfer impossible (effect indicated by cross for the sake of convenience).

As such, by transferring the range Y(1)*b* with the transfer density D set to be a high density of 1.2 to 2.0 times the highest density at a time of the ordinary image formation, and the number of lines LNb set to be greater than or equal to 10, it is possible to obtain a good cleaning effect stably.

Figure 15:
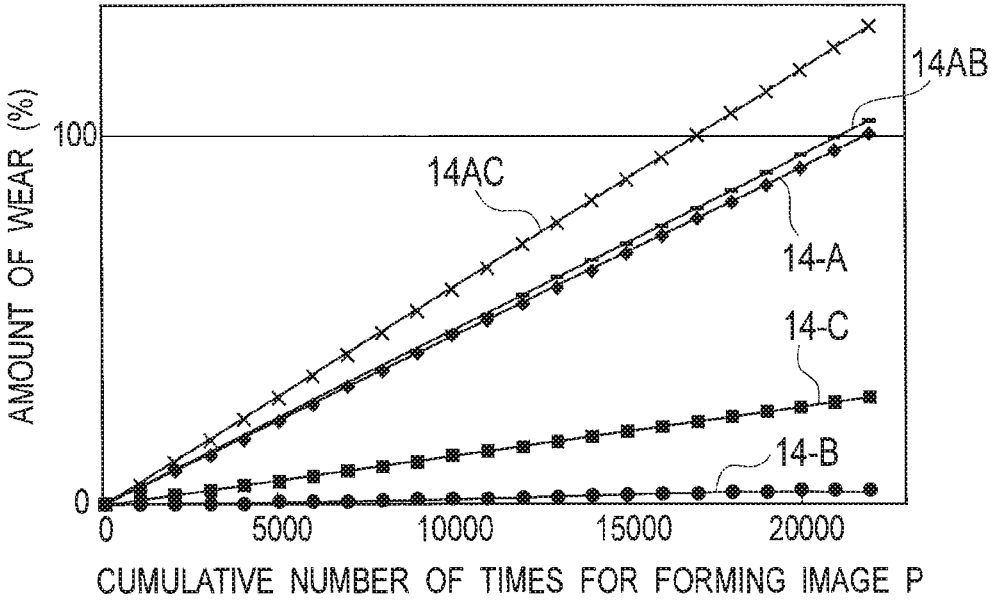
FIG. 15 is a graph for explaining a wear of heating resistors 16*a* in the thermal head 16.

On the other hand, a wear of the heating resistors 16*a* of the thermal head 16 depends on a cumulative value of the number of lines for the transfer, as shown in FIG. 15.

Consequently, from a viewpoint of making the thermal head 16 to have a longer lifetime by reducing a wear of the heating resistors 16*a*, it is preferable to make the number of lines LNb in the range Y(1)*b* as less as possible.

FIG. 15 is a graph showing a relationship between a transfer frame cumulative number (a cumulative number of times for forming the intermediate image P) and an amount of wear of the heating resistors 16*a*.

In details, the horizontal axis represents the cumulative number of times for forming the intermediate image P that is formed on the frame F, and the vertical axis represents the amount of wear of the heating resistors 16*a*.

The cumulative number of times for forming the intermediate image P on the horizontal axis is proportional to the number of lines for the transfer.

The amount of wear on the vertical axis is set such that the amount of wear in the case where the transfer is carried out until the cumulative number of times for forming the intermediate image P becomes 22000 is set to be 100%, in a graph of the amount of wear transition 14-A to be explained next.

The amount of wear transition 14-A indicates the case where the transfer of the range Y(1)*a* is carried out with the transfer density D set to be 1.0 and the number of lines LNa set to be 600, without carrying out the cleaning transfer CP.

The amount of wear transition 14-B indicates the case where only the transfer of the range Y(1)*b* is carried out with the transfer density D set to be 1.5 and the number of lines LNb set to be 10.

The amount of wear transition 14-C indicates the case where only the transfer of the range Y(1)*b* is carried out with the transfer density D set to be 1.2 and the number of lines LNb set to be 120.

The amount of wear transition 14AB indicates a sum total of the amount of wear transition 14-A and the amount of wear transition 14-B, i.e., the case where the image Y(1) is transferred and formed with the transfer density D set to be 1.5 and the number of lines LNb set to be 10 in the range Y(1)*b*.

The amount of wear transition 14AC indicates a sum total of the amount of wear transition 14-A and the amount of wear transition 14-C, i.e., the case where the image Y(1) is transferred and formed with the transfer density D set to be 1.2 and the number of lines LNb set to be 120 in the range Y(1)*b*.

As apparent from FIG. 15, the amount of wear increases as a linear function with respect to the number of lines, so that it can be seen that more the number of lines LNb, more the amount of wear at a time of forming the intermediate image P for the same number of times, and the lifetime of the thermal head 16 becomes shorter.

Also, when the number of lines LNb increases, there arises a need to take into consideration a restriction on the transfer range besides the lifetime.

More specifically, when a length Lc (see FIG. 11) in the ribbon direction of the range Y(1)*b* becomes longer such that the length Lc exceeds a margin length Ld (see FIG. 11) between the range Y(1)*a* in which the transfer of the range Y(1)*b* is possible and the frame mark 21*d*, it becomes impossible to accommodate it in one frame of the intermediate transfer film 21.

The intermediate transfer films 21 are distributed in large amounts with a length La in the ribbon direction in one frame F substantially standardized. For this reason, there is a need to set an upper limit to the number of lines LNb.

Namely, the number of lines LNb has an upper limit value determined from a viewpoint of the lifetime of the thermal head 16 and the length Lc in the ribbon direction of the frame F, and it is preferable for the number of lines LNb to be less than or equal to ⅕ (for example, 120) of the number of lines LNa (for example, 600) in the range Y(1)*a*.

So far the transfer from the yellow ink layer Y has been explained, but it is the same for the transfer from the ink layers (M, C, BK) of the other colors using the sublimation type ink.

As described above, the image formation apparatus 51 is made to carry out the cleaning transfer CP for a prescribed number of lines, with the transfer density exceeding the transfer density range of the image including the image to be re-transferred, at the end of the transfer operation for each color, at a time of forming the intermediate image P by transferring the ink of the ink layer 11*b* on the ink ribbon 11 to the intermediate transfer film 21 that is the image formation target object.

The transfer condition of the cleaning transfer CP sets the transfer density D and the number of lines LNb such that, when the range of the transfer density in the range Y(1)*a* is 0 to 1.0, the transfer density D is set to be greater than or equal to 1.2 and less than or equal to 2.0, and the prescribed number of lines LNb is set to be greater than or equal to 10. It is preferable for the upper limit of the number of lines LNb to be set to 120.

By carrying out the cleaning transfer CP, the attached substances that are mainly the lubricants that are attached and deposited on the heating resistors 16*a* in each transfer operation can be removed well, and the image in good quality over a long term can be transferred and formed on the image formation target object (the intermediate transfer film 21).

So far the exemplary case in which the cleaning transfer CP is always carried out in conjunction with the transfer operation to each frame F has been explained, but without being limited to this case, it may be made such that the cleaning transfer CP is carried out only in the case where a certain condition is satisfied.

As already mentioned, the attachment of the lubricants to the heating resistors 16*a* occurs at high possibility in the case of continuously carrying out the transfer with the low to medium density.

For this reason, for each of the plurality of the heating resistors 16*a*, it may be made such that a number of times for which a temperature is raised to a prescribed temperature range (a lowest temperature Tmin to a highest temperature Tmax) in which the temperature at a time of the transfer corresponds to the transfer with the low to medium density is counted, and the cleaning transfer CP is carried out in the case where the counted number of times becomes greater than or equal to a prescribed value determined in advance.

An exemplary case of carrying out this will be described with references to FIG. 16 and FIG. 17 as the second embodiment.

(Second Embodiment)

The image formation apparatus 51A of the second embodiment has a control unit CTA (indicated with parentheses in FIG. 1 and FIG. 2) instead of the control unit CT with respect to the image formation apparatus 51 of the first embodiment. The remaining configuration is the same as the image formation apparatus 51.

Figure 16:
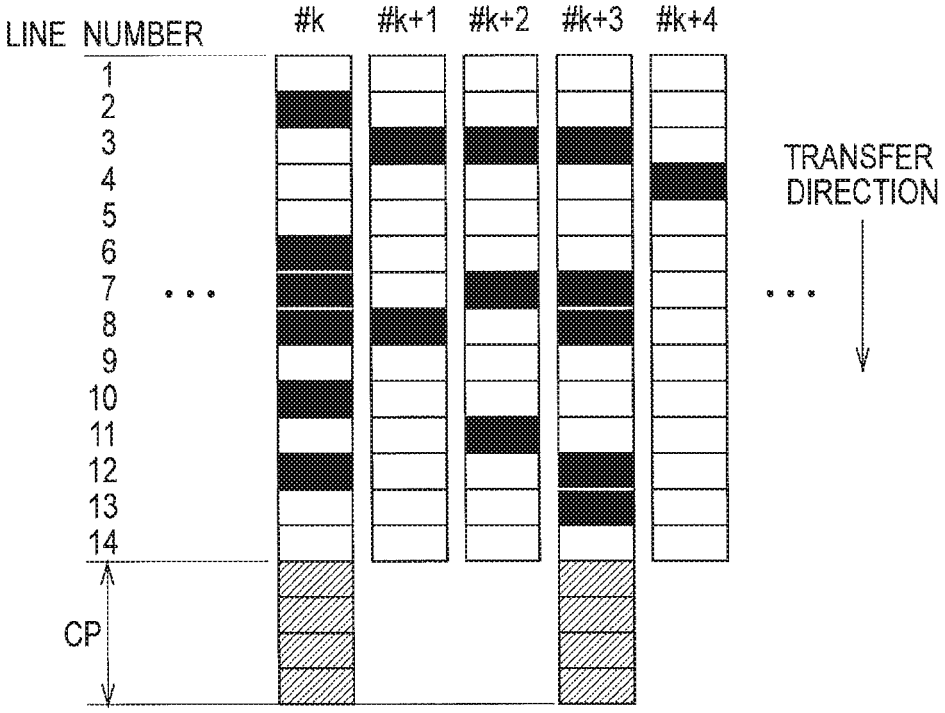
FIG. 16 is a schematic diagram for explaining a cleaning transfer CP for each of the heating resistors 16*a* in the transfer operation of an image formation apparatus 51A according to a second embodiment of the present invention.

FIG. 16 is a schematic diagram for explaining the cleaning transfer CP to be carried out by the image formation apparatus 51A. FIG. 17 is a flow chart showing an exemplary procedure when the control unit CTA judges whether the cleaning transfer CP is to be carried out or not.

In this description, as shown in FIG. 16, the transfer for the number of lines LNa equal to 14 lines (the line numbers LN#1 to LN#14) is to be carried out, for the k-th to k+4-th ($1 \leq k \leq m-4$) heating resistors 16*a*, for example, among the m sets of the heating resistors 16*a* to be used for the transfer of the range Pa.

The control unit CTA judges whether the transfer density D is contained in a range from the lowest transfer density Dmin corresponding to the lowest temperature Tmin to the highest transfer density Dmax corresponding to the highest temperature Tmax (hereafter referred to as a corresponding density range) or not, for each of the k-th to k+4-th heating resistors 16*a*, in each line.

In FIG. 16, those transfer units that are judged as contained in the corresponding density range are indicated as filled.

The control unit CTA obtains a total number of the transfer units that are judged as contained in the corresponding density range for each heating resistor, when the transfer of the line numbers LN#1 to LN#14 is finished. Also, a threshold Nc as to whether the cleaning transfer CP is to be carried out or not that is set in advance is set here to be 5, for example.

In the example of FIG. 16, the total number of the transfer units is greater than or equal to 5 for the k-th and k+3-th heating resistors, so that the cleaning transfer CP is carried out only for the k-th and k+3-th heating resistors. In this example, it is carried out for 4 lines.

Figure 17:
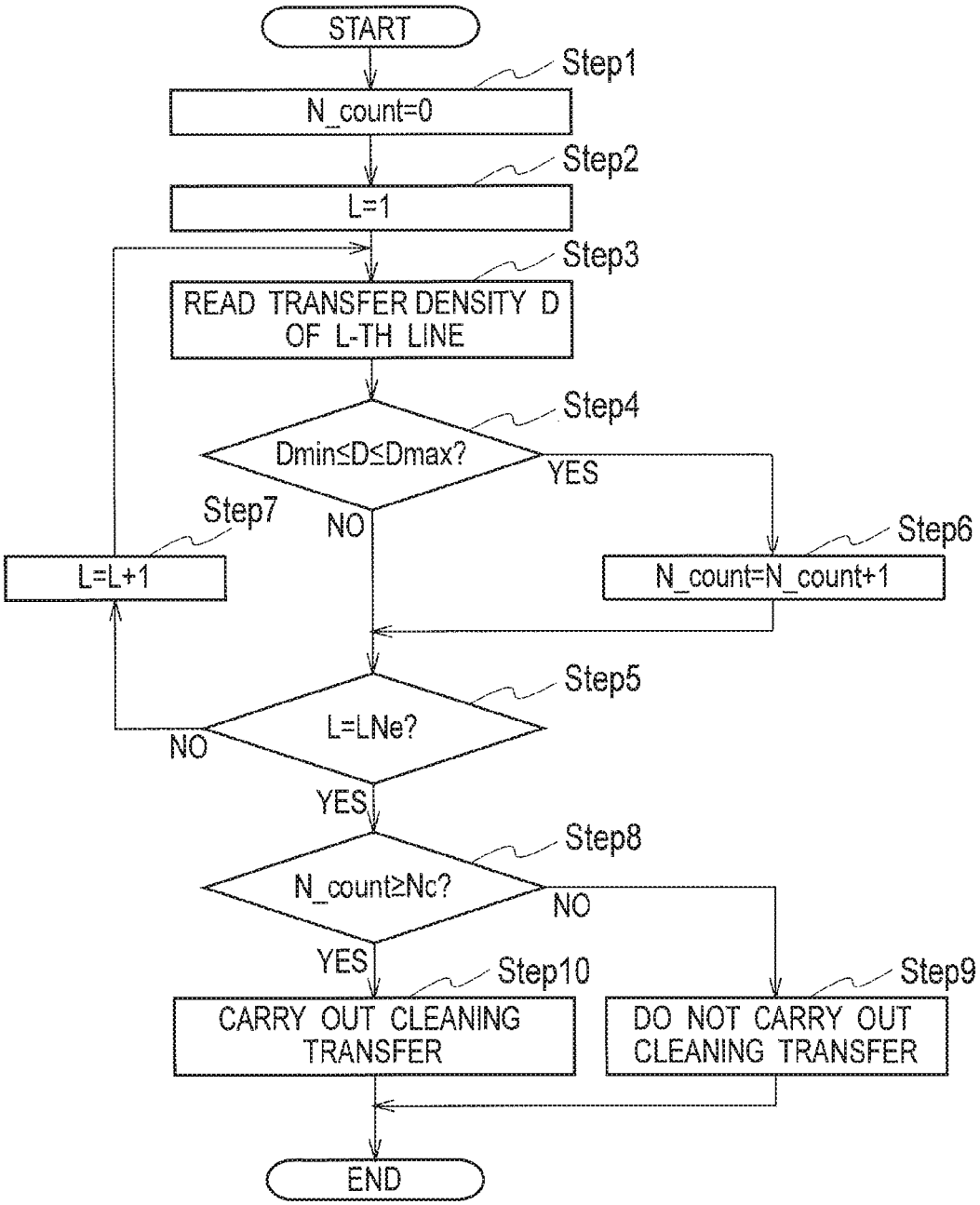
FIG. 17 is a flow chart for explaining a procedure to judge whether the cleaning operation CP is to be carried out or not in the image formation apparatus 51A.

An exemplary procedure corresponding to this control is shown in the flow chart of FIG. 17.

The control unit CTA judges whether the cleaning transfer CP is to be carried out or not according to this procedure, with respect to each of the m sets of the heating resistors 16*a*.

First, the control unit CTA sets a variable "N_count" to be incremented for the purpose of comparison with the threshold Nc to be 0 (Step1), and sets a variable "L" corresponding to the line number to be 1 (Step2).

Next, the control unit CTA reads out the transfer density D of the L-th line from the transfer image information J3 (Step3).

Next, the control unit CTA judges whether the transfer density D is contained in the corresponding density range of greater than or equal to the lowest transfer density Dmin and less than or equal to the highest transfer density Dmax or not (Step4).

When it is judged as negative in (Step4), the control unit CTA judges whether L has reached the final line LNe (the line number LN#14) or not (Step5).

When it is judged as positive in (Step4), the control unit CTA adds 1 to N_count (Step6), and proceeds to (Step5).

When it is judged as negative in (Step5), the control unit CTA adds 1 to L (Step7), and proceeds to (Step3).

When it is judged as positive in (Step5), the control unit CTA judges whether N_count has reached the threshold Nc or not (Step8).

When it is judged as negative in (Step8), the control unit CTA determines not to carry out the cleaning transfer CP (Step9), and finishes the procedure.

When it is judged as positive in (Step8), the control unit CTA determines to carry out the cleaning transfer CP (Step10), and finishes the procedure.

The control unit CTA carries out the cleaning transfer CP for the prescribed number of lines LNb, according to the judgment made by this flow chart.

According to the control procedure described above, the cleaning transfer CP is carried out only for those heating resistors 16*a* for which the cleaning is judged as necessary. Namely, the cleaning transfer CP is carried out independently for each of the n sets of the heating resistors 16*a*.

In this way, by carrying out the cleaning transfer CP with respect to the heating resistor 16*a* for which the cleaning is necessary, the attached substances that are mainly the lubricants that are attached and deposited on that heating resistor 16*a* can be removed well. For this reason, the image in good quality over a long term can be transferred and formed on the image formation target object (the intermediate transfer film 21).

Also, the unnecessary wear due to the cleaning transfer CP of the heating resistor 16*a* can be prevented, so that the thermal head 16 can be made to have a longer lifetime.

The number of lines LNb in the cleaning transfer CP is not limited to the case of being constant as described above, and a different number of lines LNb may be set depending on a size of a value of N_count.

For example, when a value of N_count that is judged as positive in (Step8) is larger, the number of lines LNb in the cleaning transfer CP is set larger. This is because when a value of N_count is larger, a possibility of having the large amount of the attached substances becomes higher.

The first and second embodiments of the present invention are not limited to the configuration and the procedure described above, and may be modified in a range not digressing from the essence of the present invention.

The image formation apparatus 51, 51A has been described in the exemplary case of being implemented in the printing apparatus PR in combination with the re-transfer apparatus 52, but it is not limited to this case.

The image formation apparatus 51, 51A may be in combination with the other apparatus. Of course, it may be a single independent apparatus as the image formation apparatus.

It suffices to carry out the separation/contact of the platen roller 26 and the thermal head 16 relatively. It may be configured such that the thermal head 16 is fixed and the platen roller 26 is separated/contacted with respect to the thermal head 16.

The control unit CT, CTA may be provided externally. In the case of providing it externally, signal exchanges by wired or wireless communications are to be carried out between the control unit CT, CTA and the apparatus main body within the casing PRa.

The number m of the heating resistors 16*a* for transferring and forming the range P(1)*a* is not limited to m<n, and may be m=n so that all of the heating resistors 16*a* are utilized.

Now, the image formation apparatus according to another embodiment of the present invention will be described as the third embodiment (the image formation apparatus 51), and in the following, the printing apparatus PR of the re-transfer scheme that has the image formation apparatus 51 of the third embodiment will be described with references to FIG. 1 to FIG. 8, FIG. 10, and FIG. 18 to FIG. 27.

(Third Embodiment)

As shown in FIG. 1, the image formation apparatus 51 is housed inside a casing PRa of the printing apparatus PR. The printing apparatus PR is a printing apparatus of a re-transfer scheme, which is the so-called card printer.

The image formation apparatus 51 is freely detachably attachable with a supply reel 12 and a winding reel 13 for an ink ribbon 11.

The supply reel 12 and the winding reel 13 that have been attached are rotated by driving a motor M12 and a motor M13 for driving respectively. Rotational speeds and rotational directions of the motors M12, M13 are controlled by a control unit CT that is provided on the image formation apparatus 51.

The ink ribbon 11 is bridged over a prescribed running route as being guided by a plurality of guide shafts 14, between the supply reel 12 and the winding reel 13.

An ink ribbon sensor 15 for cueing is arranged on a course of the running route of the ink ribbon 11.

The ink ribbon sensor 15 detects a cueing mark 11*d* of the ink ribbon 11 (see FIG. 3), and sends out a ribbon mark detection information J1 (see FIG. 2) toward the control unit CT.

A thermal head 16 is arranged between the ink ribbon sensor 15 and the winding reel 13 in the running route of the ink ribbon 11.

The thermal head 16 is separated/contacted with respect to a face on a ribbon base 11*a* side of the ink ribbon 11 that is bridged over (an arrow Da direction in FIG. 5).

This separation/contact operation of the thermal head 16 is carried out by a head separation/contact driving unit D16 under the control of the control unit CT.

The image formation apparatus 51 is freely detachably attachable with a supply reel 22 and a winding reel 23 for an intermediate transfer film 21, on left side of FIG. 1 with respect to the installed ink ribbon 11.

The supply reel 22 and the winding reel 23 that have been attached are rotated by driving a motor M22 and a motor M23 for driving respectively. Rotational speeds and rotational directions of the motors M22, M23 are controlled by the control unit CT.

The intermediate transfer film 21 is bridged over a prescribed running route as being guided by a plurality of guide shafts 24, between the supply reel 22 and the winding reel 23.

A frame mark sensor 25 for cueing is arranged on a course of the running route of the intermediate transfer film 21.

The frame mark sensor 25 detects a frame mark 21*d* of the intermediate transfer film 21 (see FIG. 4), and sends out a frame mark detection information J2 (see FIG. 2) toward the control unit CT.

The intermediate transfer film 21 has an optical transparency. For example, the frame mark sensor 25 is made to be an optical sensor, the frame mark 21*d* is formed as a part for optically blocking, and the frame mark 21*d* is detected from a difference between transmitting light and blocking light.

A platen roller 26 that is rotated by driving a motor M26 is arranged between the frame mark sensor 25 and the supply reel 22 in the running route of the intermediate transfer film 21.

A rotational speed and a rotational direction of the motor M26 are controlled by the control unit CT.

As also shown in FIG. 5, the thermal head 16 is separated/contacted with respect to the ink ribbon 11 by a separation/contact operation of the head separation/contact driving unit D16. This separation/contact operation may be done by the platen roller 26, and it suffices for the thermal head 16 and the platen roller 26 to be separated/contacted relatively.

More specifically, the thermal head 16 presses the ink ribbon 11 toward the platen roller 26, and moves between a pressed contact position (a position shown in FIG. 5) at which the intermediate transfer film 21 and the ink ribbon 11 are held and put into pressed contact between the thermal head 16 and the platen roller 26 and a separated position (a position shown in FIG. 1) at which the thermal head 16 is separated from the ink ribbon 11. When the thermal head 16 is in the pressed contact position, the transfer to be described below will be carried out.

The ink ribbon 11 and the intermediate transfer film 21 are made such that the winding to the winding reel 13, 23 side and the rewinding to the supply reel 12, 22 side can be respectively carried out independently, by the operations of the motors M12, M13 and the motors M22, M23 respectively, in a state where the thermal head 16 is in the separated position.

The ink ribbon 11 and the intermediate transfer film 21 are made such that they are movable to the supply reel side or the winding reel side while in close contact with each other, in a state where the thermal head 16 is in the pressed contact position. This movement is carried out by the rotations of the supply reels 12, 22, the winding reels 13, 23 and the platen roller 26 by driving the motors M12, M13, M22, M23 and M26, under the control of the control unit CT.

The control unit CT has an image data sending unit CT1 and an already used mark image generation unit CT2.

The image data sending unit CT1 supplies image data SN1 to be transferred respectively to transfer frames F (to be described later) of the intermediate transfer film 21, to the thermal head 16 at appropriate timing, when the thermal head 16 is in the pressed contact position. This timing is determined by the control unit CT as a whole according to the frame mark detection information J2 and the like. The image data sending unit CT1 generates the image data SN1 according to a transfer image information J3.

The already used mark image generation unit CT2 generates a control signal (hereafter referred to as a MZ transfer control signal SN2) for transferring an already used mark image for detecting the transfer frame F that is already used, and supplies the MZ transfer control signal SN2 to the thermal head 16 at appropriate timing, for each transfer frame. This timing is determined by the control unit CT as a whole to be appropriate time with respect to the identical frame, after supplying the image data SN1 from the image data sending unit CT1.

As shown in FIGS. 3A and 3B, the ink ribbon 11 has a ribbon shaped ribbon base 11*a*, and an ink layer 11*b* formed by application on the ribbon base 11*a*.

The ink layer 11*b* is formed by repeatedly applying an ink set 11*b*1 that is a set of ink layers of a plurality of colors (four colors here) arranged in a ribbon direction.

The ink set 11*b*1 comprises a yellow ink layer Y, a magenta ink layer M, a cyan ink layer C, and a black ink layer BK, which are applied in the ribbon direction in this order.

The ink of each color is of the sublimation type. There are cases in which the melting type is used for the black.

A cueing mark 11*d* is formed on one edge part of a boundary portion with the adjacent black ink layer BK in the yellow ink layer Y.

A length La in the ribbon direction of each ink layer Y, M, C and BK is the same each other. Consequently, a pitch Lap of the set of the ink layers 11*b* is set to be four times the length La.

A position of the ink ribbon sensor 15 is set such that the pressed contact position of the thermal head 16 coincides with a position of a leading edge in a running direction of the yellow ink layer Y, when the ink ribbon sensor 15 detects the cueing mark 11*d*.

Namely, a running route length from the pressed contact position to a detection position of the ink ribbon sensor 15 is set to be an integer multiple of the pitch Lap.

As shown in FIGS. 4A and 4B, the intermediate transfer film 21 has a ribbon shaped film base 21*a*, and a peeling layer 21*b* and a transfer image receiving layer 21*c*, which are formed by lamination on the film base 21*a*.

A width of the film base 21*a* is the same as a width of the ribbon base 11*a* of the ink ribbon 11.

A frame mark 21*d* is repeatedly formed at a prescribed pitch Lb in the ribbon direction, on the film base 21*a* or the transfer image receiving layer 21*c*.

The frame mark 21*d* is formed over an entire width.

The pitch Lb is the same as the length La in the ink ribbon 11 (La=Lb).

Regions partitioned in constant intervals at the pitch Lb in the intermediate transfer film 21 are transfer frames F. Hereafter the transfer frame F is referred to simply as a frame F. Namely, the frame mark 21*d* is assigned to a border portion of each frame F, so that the frames F are partitioned such that a plurality of them are arranged in the ribbon direction.

A position of the frame mark sensor 25 is set such that the pressed contact position of the thermal head 16 coincides with a position of a leading edge in a running direction of the frame mark 21*d*, when the frame mark sensor 25 detects the frame mark 21*d*.

Namely, a running route length from the pressed contact position to a detection position of the frame mark sensor 25 is set to be an integer multiple of the pitch Lb. Here, it is assumed that it is set to be four times the pitch Lb, for example.

In the image formation apparatus 51, the intermediate transfer film 21 and the ink ribbon 11 are bridged over as shown in FIG. 5, in orientations in which the transfer image receiving layer 21*c* and the ink layer 11*b* are directly facing each other.

The transfer image receiving layer 21*c* has a property for receiving and fixing the ink of the ink layer 11*b* that is sublimated by heating. In the case where the ink of the black ink layer BK is of the melting type, the transfer image receiving layer 21*c* receives and fixes the black ink that is melted by heating.

In this way, in the pressed contact state of the thermal head 16 as shown in FIG. 5, the ink from the ink layer 11*b* that is in pressed contact with the transfer image receiving layer 21*c* is transferred, and an image is formed on the transfer image receiving layer 21*c*. The ink is transferred in a heating pattern according to the image data SN1 supplied to the thermal head 16.

The image formation apparatus 51 described in detail above is made such that the ink ribbon 11 and the intermediate transfer film 21 that are set by a user can be moved while being in close contact by the pressing of the thermal head 16.

As shown in FIG. 6, the thermal head 16 has n sets of heating resistors 16*a* (n is an integer greater than or equal to 2) from #1 to #n that are arranged and aligned in a width direction of the ink ribbon 11. Also, the thermal head 16 has head drivers 16*b* for conducting electricity independently to respective one of the plurality of heating resistors 16*a*, according to the image data SN1 and the MZ transfer control signal SN2.

The heating resistors 16*a* are arranged to be 300 sets per one inch, for example.

The head drivers 16*b* carry out the electricity conduction with respect to respective one of the plurality of the heating resistors 16*a*, based on the image data SN1 to be transferred that is sent out from the image data sending unit CT1 and the MZ transfer control signal SN2 that is sent out from the already used mark image generation unit CT2.

Usually, the heating resistors 16*a* that correspond to the image to be formed are not all the heating resistors 16*a* in a total number n, and set to be neighboring m sets (m is an integer greater than or equal to 1 for which m<n) with margins on both ends in the arranging direction. Namely, among the plurality of the heating resistors 16*a* that are arranged, (n−m) sets are not used for the image formation, as margins. Also, the m sets of the heating resistors 16*a* are selected to be consecutive m sets excluding a heating resistor of at least one end among the n sets.

Consequently, when a number of lines in the ribbon direction (longitudinal) of the image to be transferred (corresponding to a number for which the ON and OFF of the electricity conduction can be selected) is set as a number of line LNa, the image is formed by width×longitudinal=m×LNa dots, on the intermediate transfer film 21 which is the image formation target object.

For example, as the printing apparatus PR, in the case of forming the image of 300 dpi on the card of outer dimensions 86 mm×54 mm which is a re-transfer target object, m is set to be approximately 1000 and a value of LNa is set to be approximately 600.

The image formation apparatus 51 makes the transfer of the ink of the ink layer 11*b* of the ink ribbon 11 to the transfer image receiving layer 21*c* of the intermediate transfer film 21, by appropriately heating respective heating resistors 16*a* of the thermal head 16, according to the image data to be transferred, while moving the ink ribbon 11 and the intermediate transfer film 21 in close contact.

In this way, a desired image can be transferred and formed on a frame of the transfer image receiving layer 21*c*. Details of this image formation operation will be described later.

Returning to FIG. 1, the printing apparatus PR has a re-transfer apparatus (or a re-transfer unit) 52 for re-transferring a part of the image formed on the transfer image receiving layer 21*c* (hereafter also referred to as an intermediate image P) of the intermediate transfer film 21 which is the image formation target object by the image formation apparatus 51, to a further transfer target object.

Here, a further transfer target object is a card 31. In FIG. 1, the card 31 during a transportation is indicated by a thick solid line.

The re-transfer apparatus 52 shares the control unit CT with the image formation apparatus 51.

The re-transfer apparatus 52 has a re-transfer unit ST1 provided between the platen roller 26 and the winding reel 23 in the running route of the intermediate transfer film 21, a feeding unit ST2 for feeding the card 31 to the re-transfer unit ST1, and a take out unit ST3 for taking out the card 31 that passed the re-transfer unit ST1.

The re-transfer unit ST1 has a heat roller 41 that is rotated by a motor M41, an opposing roller 42 that is arranged opposite to the heat roller 41, and a heat roller driving unit D41 for separating/contacting the heat roller 41 with respect to the opposing roller 42.

The feeding unit ST2 has a posture conversion unit ST2*a* for rotating a posture of the card 31 by 90° such that it is converted from vertical to horizontal, while holding the card 31.

The feeding unit ST2 further has a lifting roller 33 for rotating to lift the rightmost one in FIG. 1 upward, among the plurality of cards 31 that are loaded in the standing postures at a stacker 32.

The feeding unit ST2 also further has a pair of feeding rollers 34 for holding and feeding the card 31 lifted by the lifting roller 33 to the posture conversion unit ST2*a* arranged on an upper side, and a plurality of pairs of transporting rollers 35 for transporting the card 31 that is converted into a horizontal posture by the posture conversion unit ST2*a* to the re-transfer unit ST1 on a left side.

An operation of the motor M41 is controlled by the control unit CT. Also, the lifting roller 33, the feeding rollers 34, and the transporting rollers 35 are rotated by driving motors not shown in the figure, respectively under the control of the control unit CT.

The re-transfer apparatus 52 converts one card 31 that is taken out to an upper side in the vertical posture from the stacker 32 in the feeding unit ST2 to the horizontal posture at the posture conversion unit ST2*a*, and transports and supplies this card 31 to the re-transfer unit ST1.

In the re-transfer unit ST1, the card 31 moves toward the take out unit ST3 by driving the motor M41, while being in pressed contact and held with the intermediate transfer film 21 between the temperature increased heat roller 41 and the opposing roller 42, by the operation of the heat roller driving unit D41. To the card 31, the transfer image receiving layer 21*c* of the intermediate transfer film 21 is put in pressed contact.

With this pressed contact moving, a range of a part of the intermediate image P formed on the transfer image receiving layer 21*c* by the image formation apparatus 51 is transferred to the card 31. Namely, the image Pc is formed by the re-transfer on a surface of the card 31.

The card 31 with the image Pc re-transferred and formed thereon is transported to the take out unit ST3, and accumulated and stored in an external stocker 36, for example.

The timing of the re-transfer is not limited. Once the intermediate image P is formed in one frame F, the re-transfer may be carried out before forming the intermediate image P in next frame F. Also, the re-transfer may be carried out after forming the intermediate images P in a plurality of the frames F together.

The image formation apparatus 51 has a memory unit MR and a communication unit 37, along with the control unit CT. The memory unit MR stores in advance an operation program for carrying out the operation of the printing apparatus PR as a whole including the image formation apparatus 51, a transfer image information J3 that is an information of the image to be transferred, and the like. The memory contents of the memory unit MR are appropriately referred by the control unit CT.

The operation program and the transfer image information J3 are supplied to the control unit CT via the communication unit 37 from an external data device 38 and the like (see FIG. 2), and stored in the memory unit MR.

Also, the control unit CT stores a power OFF reason information as to whether the power is turned OFF as a normal finishing or the power is turned OFF as an error processing (to be described later) at a time of the occurrence of abnormality, at a time of turning the power of the image formation apparatus 51 or the printing apparatus PR OFF, as a non-volatile information in a non-volatile memory region of the memory unit MR.

After this turning OFF of the power, when the power is turned ON again, the control unit CT refers to the power OFF reason information stored in the memory unit MR, and determines a next operation (for example, a procedure for an unused frame cueing operation to be described later) according to the content of that information.

Next, the image formation operation and method with respect to the intermediate transfer film 21 by the image formation apparatus 51 will be described with references to FIG. 7, FIG. 8, FIG. 10, and FIG. 18 to FIG. 20.

The image formation apparatus 51 carries out a rewinding operation and a cueing operation in each of the transfer operation for four colors.

First, a procedure for transferring and forming the image P(1) on the frame F1, which is the first frame on which the image is to be formed, in the intermediate transfer film 21, will be described with references mainly to FIG. 7, FIG. 8 and FIG. 18.

In FIG. 7 and FIG. 8, positions and transfer contents of the ink ribbon 11 and the intermediate transfer film 21 with respect to the thermal head 16 that is not moving in a moving direction of the ink ribbon 11 (whose position is determined) are shown. Also, a face of the ink layer 11*b* on the ink ribbon 11 and the transfer image receiving layer 21*c* on the intermediate transfer layer 21 which are facing each other in close contact in the transfer operation are shown to be arranged in left and right.

Also, in FIG. 7 and FIG. 8, the ink sets 11*b*1 to be provided for the transfer are assigned with serial numbers starting from 1 for the sake of explanation. For example, Y1 to BK1 indicates the yellow ink layer to the black ink layer of the first set.

Also, for the frame F, serial numbers are assigned in the order of frames on which the image is to be transferred and formed. For example, F3 indicate a third frame on which the image is to be transferred and formed.

Also, the images to be transferred are indicated with serial numbers within parentheses ( ). For example, the image M(1) means the first image (an image to be formed on the frame F1) to be transferred with the magenta ink. Similarly, the image C(1) means the first image (an image to be formed on the frame F1) to be transferred with the cyan ink.

Figure 18:
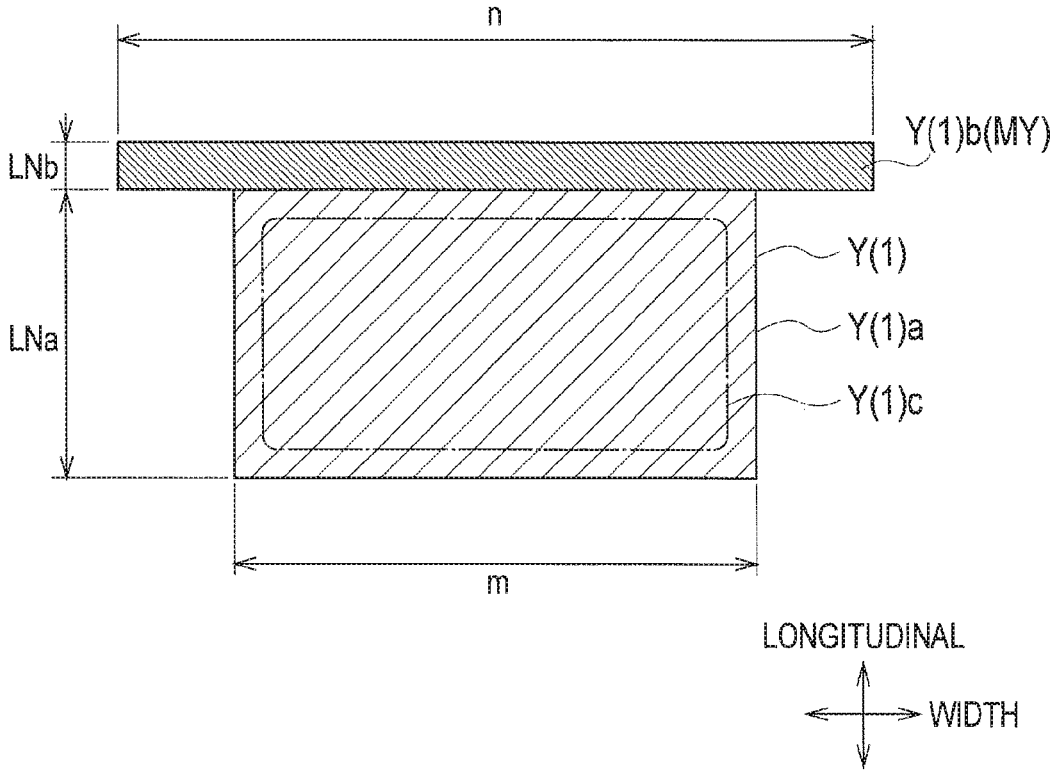
FIG. 18 is a diagram for explaining an image Y(1) that is transferred to a frame F1 in an intermediate transfer film 21 to be used in an image formation apparatus according to a third embodiment of the present invention.

FIG. 18 is a diagram in which the image Y(1) that has been transferred and formed on the intermediate transfer film 21 is extracted for the sake of explanation.

First, as shown in FIG. 7, the alignment of the yellow ink layer Y1 and the frame F1 is carried out by the cueing operation.

Next, the image Y(1) is transferred on the frame F1 with the ink of the yellow ink layer Y1, while moving the ink ribbon 11 and the intermediate transfer film 21 in close contact to a lower side of FIG. 7 with the thermal head 16 put in the pressed contact state.

This close contact moving is for one frame part. A sending direction is a winding direction (forward feeding) for the ink ribbon 11 and a rewinding direction (backward feeding) for the intermediate transfer film 21.

FIG. 8 shows the image Y(1) in a state of having the transfer finished.

On the frame F1 of the intermediate transfer film 21, the image Y(1) of the yellow ink has been transferred and formed. Also, the ink layer Y1 on the ink ribbon 11 has been in a state where the ink in a range (indicated as shaded) corresponding to the image Y(1) is less than other ranges or completely absent.

FIG. 18 is a diagram in which the image Y(1) that has been transferred and formed on the intermediate transfer film 21 is extracted for the sake of explanation.

Figure 19:
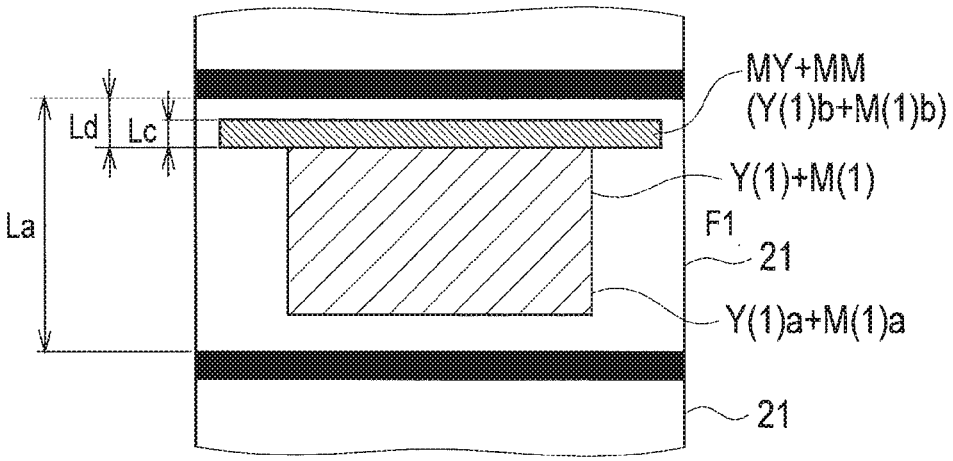
FIG. 19 is a diagram for explaining a transferred image of the frame F1 that is formed by the superposed transfer of ink of the ink layer Y1 and the ink layer M1 in the image formation apparatus according to a third embodiment of the present invention.

As shown in FIG. 19, the image Y(1) is formed by two ranges. Namely, these are a rectangular range Y(1)*a* in which the width direction is corresponding to the m sets of the heating resistors 16*a* while the longitudinal direction is corresponding to the number of lines LNa, and a thin rectangular range Y(1)*b* in which the width direction is corresponding to the n sets of the heating resistors 16*a* which are extending out from both sides of the range Y(1)*a* while the longitudinal direction is corresponding to the number of lines LNb which is less than the number of lines LNa.

In this example, an exemplary case of extending out on both sides is shown. In the following, this rectangular range Y(1)*b* that is formed by the transfer of the yellow ink will also be referred to as an already used mark MY.

The already used mark MY is formed before transferring the range Y(1)*a*, or after transferring the range Y(1)*a*. Here, the exemplary case of forming the already used mark MY after transferring the range Y(1)*a* will be described.

Also, in this example, the range Y(1)*a* and the already used mark MY are transferred and formed continuously, but they may be transferred and formed with a separation in the longitudinal direction.

A re-transfer range Y(1)*c* to be re-transferred on a re-transfer target object by the re-transfer apparatus 52 is smaller than the range Y(1)*a*, and made to be completely contained inside the range Y(1)*a* in both the longitudinal direction and the width direction.

As shown in FIG. 8, to the frame F1 on which the image Y(1) has been transferred with the ink of the yellow ink layer Y1, the image M(1) is to be transferred in superposition with the ink of the magenta ink layer M1 next.

First, as shown in FIG. 10, the alignment of the magenta ink layer M1 and the frame F1 is carried out by the cueing operation. In this cueing operation, the thermal head 16 is set to be in the separated position that is separated from the ink ribbon 11, the ink ribbon 11 is sent out (forward feeding) to a lower side from a state of FIG. 8, and the intermediate transfer film 21 is rewound (forward feeding) to an upper side from a state of FIG. 8.

Next, the image M(1) is transferred on the frame Fl with the ink of the magenta ink layer M1, while moving the ink ribbon 11 and the intermediate transfer film 21 in close contact to a lower side of FIG. 10 with the thermal head 16 put in the pressed contact state.

Here, for the sake of ease in understanding, it is assumed that shapes and ranges of the image Y(1) and the image M(1) are the same. Namely, the image M(1) comprises a range M(1)*a* of m×LNa which is identical to the range Y(1)*a*, and a range M(1)*b* of a thin rectangular shape which is identical to the already used mark MY. The range M(1)*b* that is formed by the magenta ink will be referred to as an already used mark MM in the following.

In this way, the image in which the image Y(1) and the image M(1) are superposed as shown in FIG. 19 is obtained on the frame F1.

Also, the range M(1)*a* is superposed over the range Y(1)*a*, and the already used mark MM is superposed over the already used mark MY.

Similarly, the image C(1) and the image BK(1) of the same shape and range as the image Y(1) are transferred on the frame F1 sequentially, from the cyan ink layer C1 and the black ink layer BK1 respectively.

Figure 20:
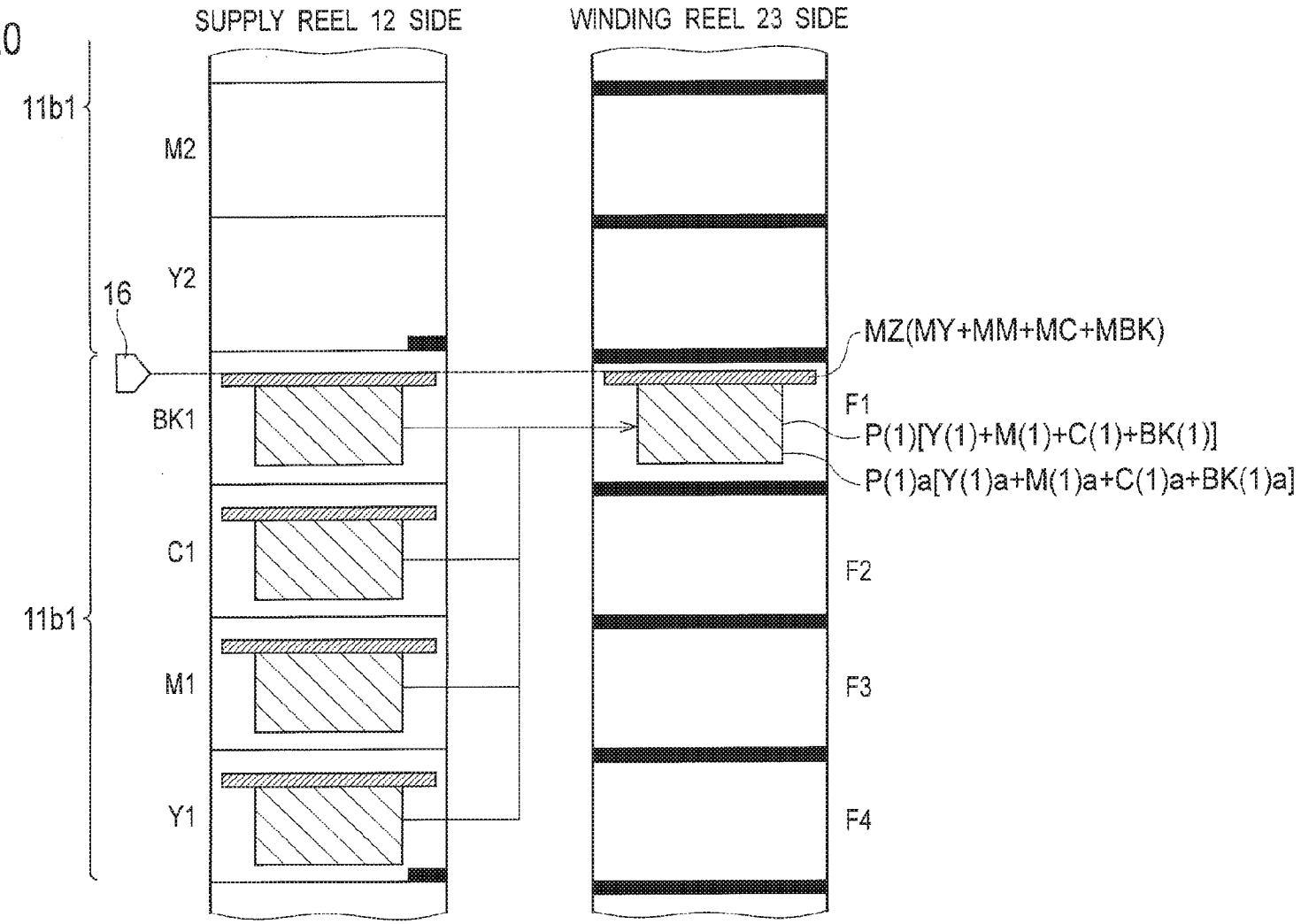
FIG. 20 is a diagram for explaining an image P(1) that is formed on the frame F1 in the image formation apparatus according to a third embodiment of the present invention.

FIG. 20 shows the image BK(1) of the fourth color in a state of having the transfer finished.

Namely, on the frame F1, the image P(1) has been formed as the intermediate image P as the image Y(1), the image M(1), the image C(1) and the image BK(1) have been transferred in superposition.

In the image P(1), the range P(1)*a* is formed by superposing the range Y(1)*a*, the range M(1)*a*, the range C(1)*a* and the range BK(1)*a*, and the already used mark MZ is formed by superposing the already used mark MY, the already used mark MM, the already used mark MC for the cyan ink, and the already used mark MBK for the black ink.

As such, the image P(1) is formed by including the image of the range P(1)*a* and the image of the range P(1)*b*. The range P(1)*a* is the image that is transferred and formed according to the image data SN1 supplied from the image data sending unit CT1, and the range P(1)*b* is the image for detecting the already used transfer frame that is transferred and formed according to the MZ transfer control signal SN2 generated at the already used mark image generation unit CT2.

On the frame F2 and subsequent frames, the image P(2) and subsequent images can be formed similarly as the frame F1.

Then, a part of the intermediate image P formed on each frame P is transferred as the image Pc on the card 31, by the re-transfer apparatus 52.

Figure 21:
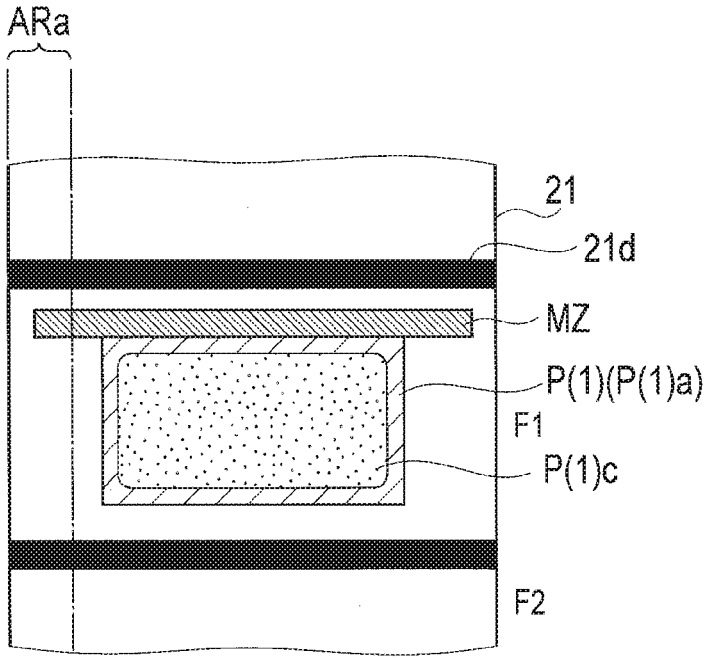
FIG. 21 is a diagram for explaining a state after a re-transfer of the image P(1) that is formed on the frame F1 in the image formation apparatus according to a third embodiment of the present invention.

FIG. 21 shows a state after re-transferring the image P(1) that has been formed on the frame F1 in the intermediate transfer film 21, as shown in FIG. 20, to the card 31.

A part of the range P(1)*a* of the image P(1) is transferred to the card 31 to become the re-transfer range P(1)*c*.

Consequently, there is no influence on the re-transfer image on the card 31 even when the already used mark MZ is provided.

In order to be capable of being detected by the frame mark sensor 25, the already used mark MZ is formed as follows.

First, as shown in FIG. 21, the already used mark MZ has a portion that goes into a detection region ARa of the frame mark sensor 25. The detection region ARa is a prescribed distance range on an edge portion of the intermediate transfer film 21.

Also, the already used mark MZ is transferred and formed in color, density and the number of lines that are capable of being detected by the frame mark sensor 25.

As the image formation apparatus 51, which one of the both edge portions of the intermediate transfer film 21 should the frame mark sensor 25 be arranged is not limited. Namely, either one of the arrangement for detecting an edge portion on left side and the arrangement for detecting an edge portion on right side in FIG. 21 can be adopted.

In the case where it is contemplated that the intermediate transfer film 21 is to be re-bridged over and re-used among the image formation apparatuses 51 with different arrangement positions for the frame mark sensor 25, as shown in FIG. 21, the already used mark MZ may be formed by extending out on both sides of left and right with respect to the range P(1)*a*.

The frame mark sensor 25 is made to be an optical sensor in general, and a binary signal for the transmission of the transmitted light and the blocking of the transmitted light due to the frame mark 21*d* is outputted as the frame mark detection information J2. Because of the photo-detecting characteristic of the optical sensor in general, a difference between the transmission and the blocking is hard to obtain in colors of yellow and magenta.

In the transfer of the intermediate image P, including the case where the intermediate image P is a color image, the ink of a color according to that color component is transferred selectively. On the other hand, it is preferable for the already used mark MZ among the intermediate image P to be formed by including either one of the already used mark MC in the cyan ink and the already used mark MBK in the black ink for which the binary signal can be obtained relatively surely, regardless of the color component of the intermediate image P.

Next, the cueing operation for the unused frame utilizing the already used mark MZ in the image formation apparatus 51 will be described with references to FIGS. 22A and 22B to FIG. 27.

In FIGS. 22A and 22B, FIG. 24, FIGS. 25A and 25B, and FIG. 27, the intermediate image P is shown as one for which the re-transfer is not carried out.

First, the unused frame cueing operation in the case of an error recovery will be described.

Namely, when some trouble (such as a failure in transporting the card 31) occurs in the image formation apparatus 51 or the printing apparatus PR in a middle of the transfer to some frame Fk in the intermediate transfer film 21, the printing apparatus PR is made to stop automatically as an error processing.

After the power is turned OFF as this error processing, the error recovery is what resolves the trouble and turns the power ON again to resume the operation of the apparatus.

The control unit CT judges whether the power is turned ON by the error recovery or the power is turned ON by the normal activation, according to the power OFF reason information that is stored in the memory unit MR.

Figure 22A:
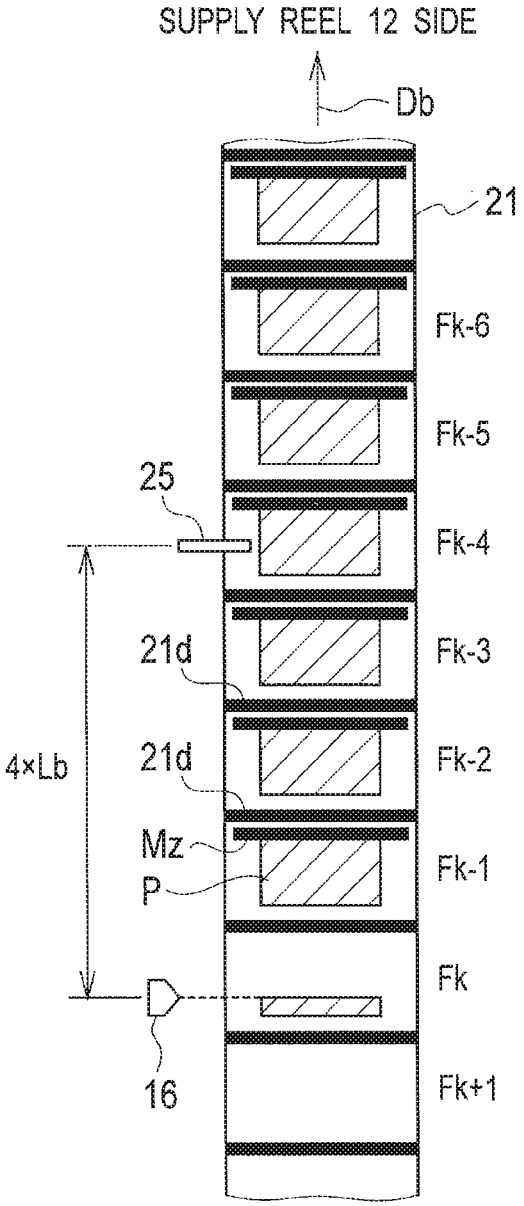
FIGS. 22A and 22B are a first set of diagrams for explaining a cueing operation for an unused frame F in the case of an error recovery.

FIG. 22A is a diagram showing a positional relationship of the intermediate transfer film 21, the thermal head 16 and the frame mark sensor 25, at a time of the automatic stop by the error processing.

Here, it is assumed that it has stopped in a middle of the transfer of the ink from the yellow ink layer Y on the k-th frame Fk.

In the frame Fk−1 and the like which is before the frame Fk, the complete intermediate image P including the already used mark MZ has been formed. In the frame Fk, a part of the image Y(k)a has already been transferred and formed, but due to the stop in a middle, the already used mark MY that is to be transferred last has not been transferred and formed.

The thermal head 16 is in a middle position in the ribbon direction in the frame Fk, and the frame mark sensor 25 is in a position distanced by four times the pitch Lb of the frame on the winding reel 23 side from the thermal head 16. Namely, it is in a middle position of the frame Fk−4.

After the power is turned OFF by the error processing in a middle of the transfer, in the error recovery in which the power is turned ON again, an operation log immediately before turning the power OFF due to the abnormal finishing is reset. Namely, a correspondence information for the position of the thermal head 16 and the frame number is lost.

For this reason, the control unit CT moves the intermediate transfer film 21 at a constant speed to be wound by the winding reel 23 (see an arrow Db), and monitors the frame mark detection information J2.

Figure 23:
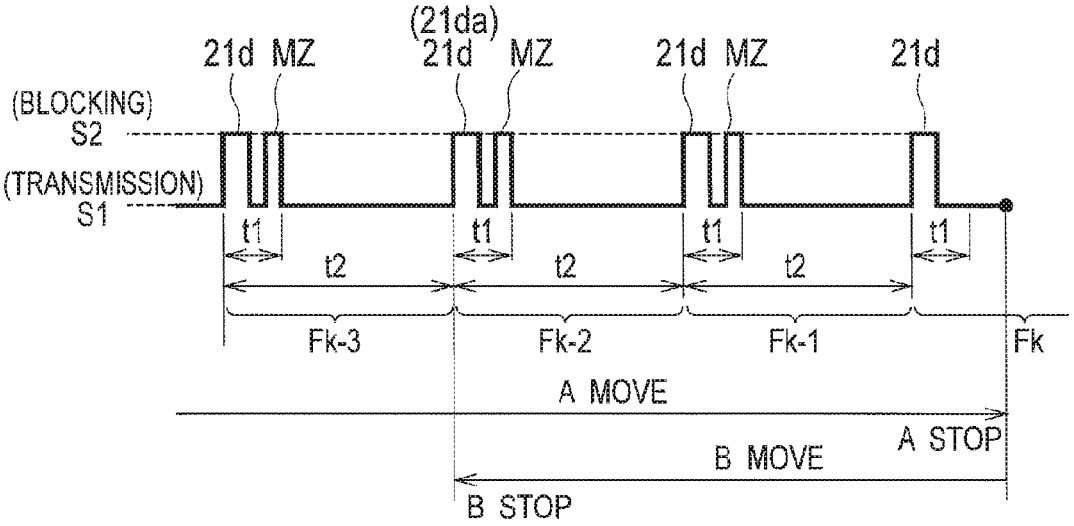
FIG. 23 is a second diagram for explaining the cueing operation for the unused frame F in the case of the error recovery.

FIG. 23 shows the frame mark detection information J2 when the intermediate transfer film 21 is moved at a constant speed from a state shown in FIG. 22A to the winding reel 23 side (A Move).

The frame mark detection information J2 is provided as a binary signal of a S1 value when the light is transmitted and a S2 value when the light is blocked. The frame mark sensor 25 is made to be capable of detecting the S1 value and the S2 value in two marks including the frame mark 21*d* and the already used mark MZ.

In this way, a set of two S2 signals corresponding to the frame mark 21*d* and the already used mark MZ is detected regularly at a period t2, up to the frame Fk−1 for which the transfer has been carried out normally, i.e., up to the frame mark 21*d* at a boundary of the frame Fk−2 and the frame Fk−1.

However, because the already used mark MZ is not formed on the frame Fk, only one S2 signal corresponding to the frame mark 21*d* is detected at a boundary of the frame Fk−1 and the frame Fk.

In the case where a set of two S2 signals is detected, the control unit CT monitors a time from a rise of the first S2 signal (corresponding to the frame mark 21*d*) to a fall of the second S2 signal (corresponding to the already used mark MZ) as a period t2.

Namely, after the period t2 has elapsed and the first S2 signal is detected, while the period t2 elapses, whether the second S2 signal is detected or not is judged.

If the second S2 signal (corresponding to the already used mark MZ) is detected, it is judged that the frame mark sensor 25 is still in the already used frame.

On the other hand, if the second S2 signal is not detected, it is judged that the frame mark sensor 25 has entered into the frame Fk that is stopped in a middle, and the winding movement of the intermediate transfer film 21 is stopped (A Stop in FIG. 23). This state is shown in FIG. 22B.

Next, the control unit CT cues the thermal head 16 to a completely unused frame Fk+1 that is ahead by one of the frame Fk for which the transfer has finished in a middle.

Figure 22B:
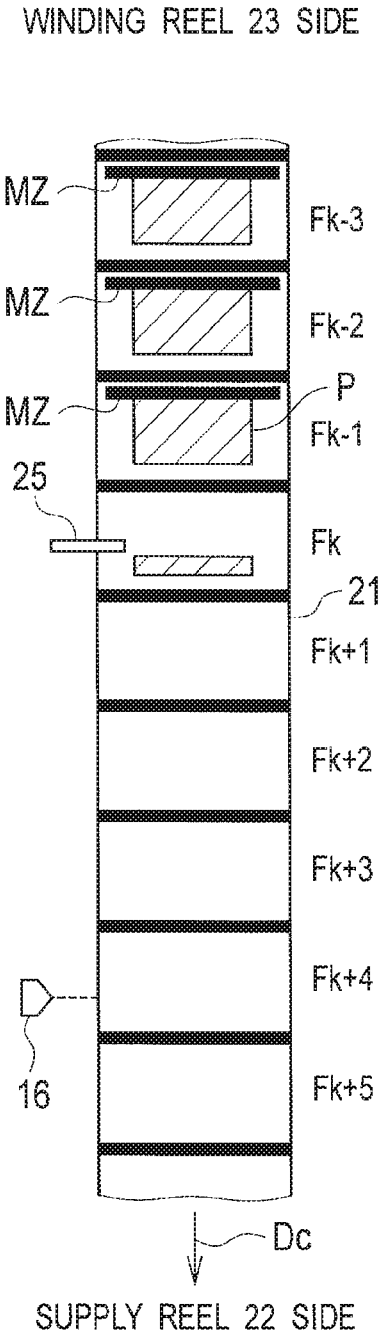

More specifically, the intermediate transfer film 21 is fed backward to the supply reel 22 side (see an arrow Dc in FIG. 22B).

The frame mark detection information J2 that is detected by this backward feeding movement will be one that traced the binary transition of FIG. 23 from a position of (A Stop) toward a left side (B Move).

When the second set of S2 signals is detected, the control unit CT stops the feeding movement at a fall position (a left edge portion in FIG. 23) of the second S2 signal (corresponding to the frame mark 21*da*) of that set. In practice, after detecting the S2 signal corresponding to the frame mark 21*da*, the positioning may be made by the forward feeding after continuing the backward feeding for a prescribed distance.

Figure 24:
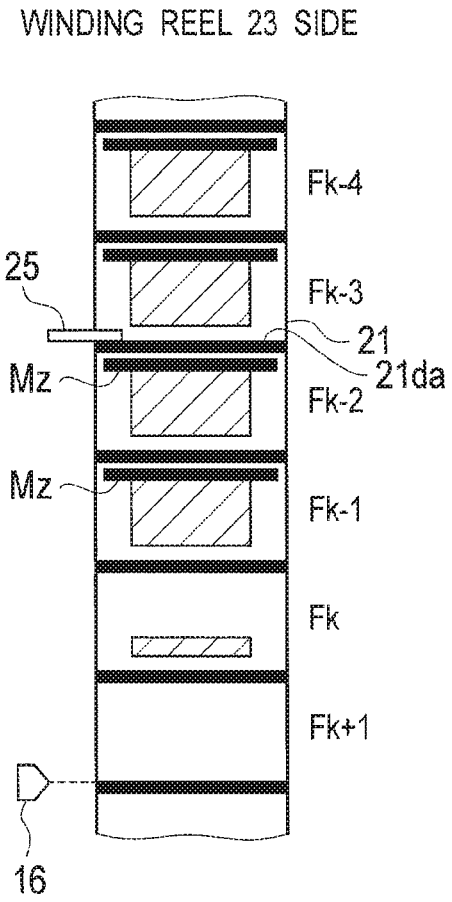
FIG. 24 is a third diagram for explaining the cueing operation for the unused frame F in the case of the error recovery.

In this way, the position of the frame mark sensor 25 is at an edge portion on the frame Fk−3 side of the frame mark 21*da* that is at a boundary of the frame Fk−3 and the frame Fk−2, as shown in FIG. 24.

In this state, the thermal head 16 is at the cueing position of the first unused frame Fk+1, so that the cueing is completed.

Next, the unused frame cueing operation in the case of the re-installment of the intermediate transfer film 21 will be described.

Namely, it is the case where the transfer is completed up to some frame Fk in the intermediate transfer film 21, and after that, the intermediate transfer film 21 is taken out along with the winding reel 23 and the supply reel 22 that are detachable, for the sake of the maintenance and the like, and then re-installed.

First, the case in which the intermediate transfer film 21 is wound around the winding reel 23 side and re-installed will be described.

Figure 25A:
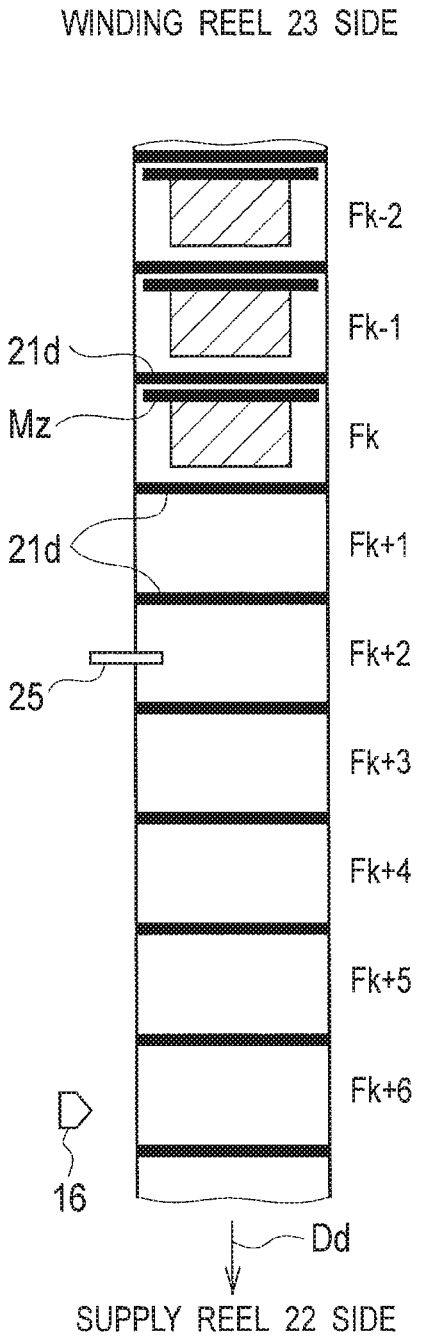
FIGS. 25A and 25B are a first set of diagrams for explaining a cueing operation for an unused frame F in the case of a re-installment of the intermediate transfer film 21.

In this case, after the re-installment of the winding reel 23, the control unit CT moves the intermediate transfer film 21 to the supply reel 22 side at a constant speed by the backward feeding, as shown in FIG. 25A (see an arrow Dd).

The intermediate transfer film 21 has the unused frames on the supply reel 22 side, so that a portion of the first unused frame passes the frame mark sensor 25, and after moving by the backward feeding to some extent, the leading already used frame Fk enters the frame mark sensor 25.

Figure 26A:
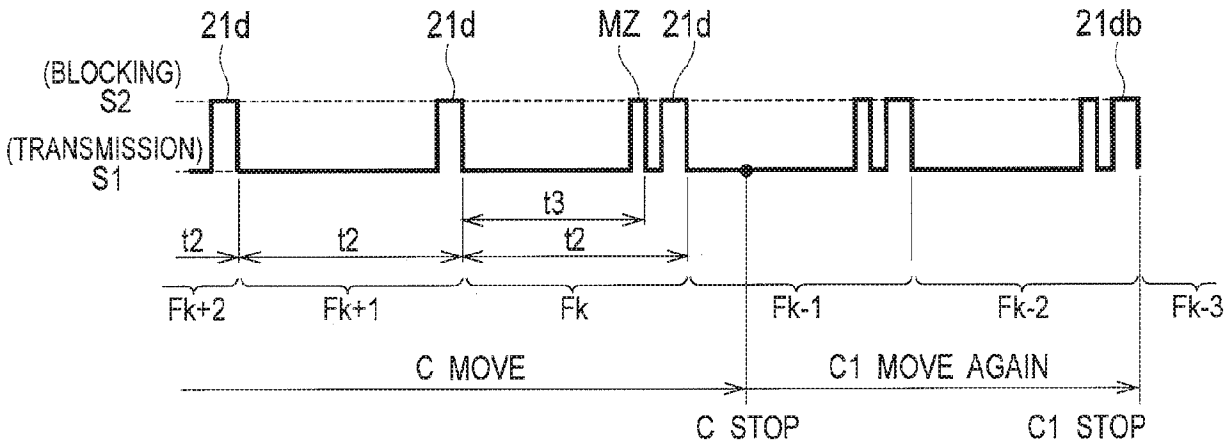
FIGS. 26A and 26B are a second set of diagrams for explaining the cueing operation for the unused frame F in the case of the re-installment of the intermediate transfer film 21.

FIG. 26A shows the frame mark detection information J2 in this backward feeding movement (C Move).

Namely, when the consecutive unused frames are passing the frame mark sensor 25, one S2 signal corresponding to the frame mark 21*d* is regularly obtained at a period t2.

Then, when the frame mark sensor 25 enters from the leading already used frame Fk to the neighboring already used frame Fk−1, a set of two S2 signals that are close in time corresponding to the already used mark MZ and the frame mark 21*d* is obtained.

When the set of two S2 signals is obtained, the control unit CT stops the backward feeding movement (C Stop).

At this point, the frame mark sensor 25 is in a middle of the frame Fk−1, and the thermal head 16 is in a middle of the frame Fk+3.

Here, the first unused frame is the frame Fk+1, so that in order to move the thermal head 16 to the cueing position of the frame Fk+1, the control unit CT moves the intermediate transfer film 21 by the backward feeding again (C1 Move Again), and after that movement, it is stopped at a fall position of the second S2 signal in the set that has been detected second as the set of S2 signals (C1 Stop).

Figure 27:
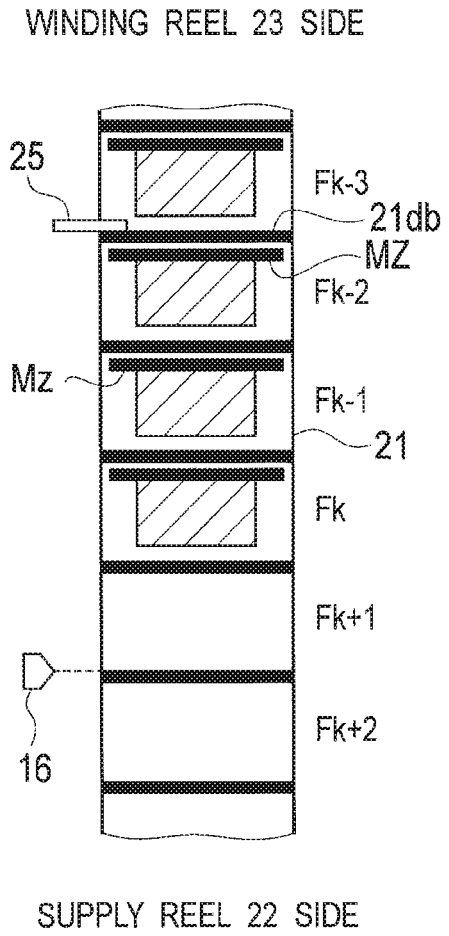
FIG. 27 is a third diagram for explaining the cueing operation for the unused frame F in the case of the re-installment of the intermediate transfer film 21.

This second S2 signal corresponds to the frame mark 21*db* at a boundary of the frame Fk−2 and the frame Fk−3, as also shown in FIG. 27.

In this state, the thermal head 16 is at the cueing position of the first unused frame Fk+1, so that the cueing is completed.

Next, the case in which the intermediate transfer film 21 is wound around the supply reel 22 side and re-installed will be described.

Figure 25B:
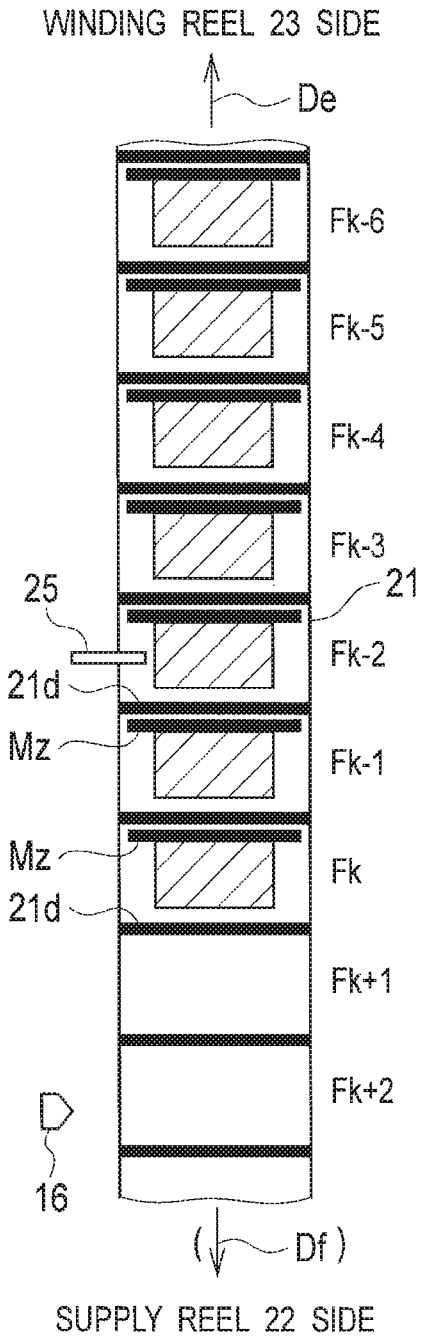

In this case, after the re-installment of the supply reel 22, the control unit CT moves the intermediate transfer film 21 to the winding reel 23 side at a constant speed by the forward feeding, as shown in FIG. 25B (see an arrow De).

The intermediate transfer film 21 has the unused frames on the winding reel 23 side, so that a portion of the first already used frame passes the frame mark sensor 25, and after moving by the forward feeding to some extent, the leading unused frame Fk+1 enters the frame mark sensor 25.

Figure 26B:
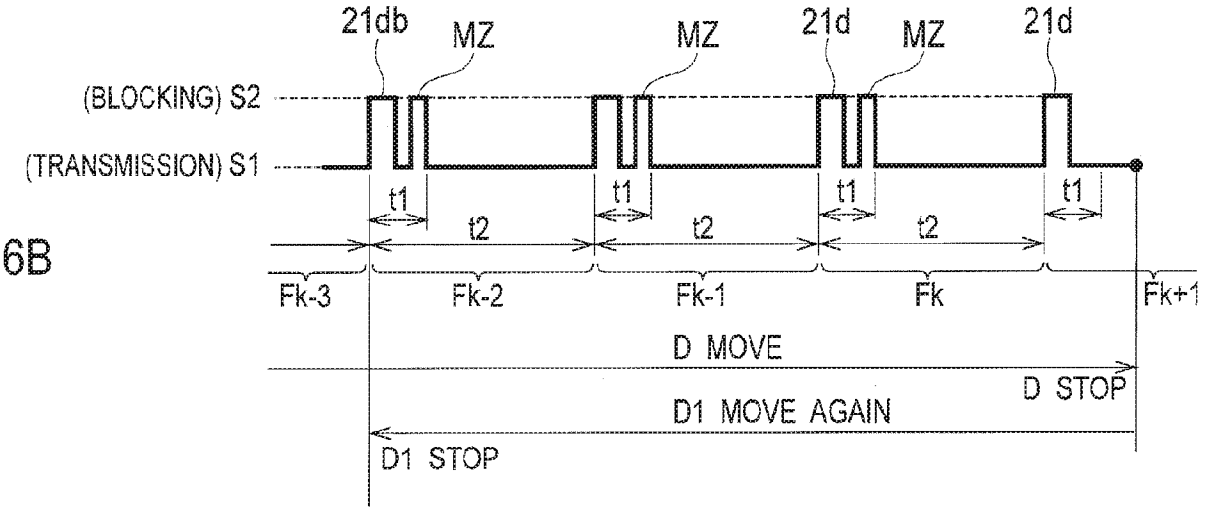

FIG. 26B shows the frame mark detection information J2 in this forward feeding movement (D Move).

Namely, when the consecutive already used frames are passing the frame mark sensor 25, a set of two S2 signals that are close in time corresponding to a set of the frame mark 21*d* and the already used mark MZ is regularly obtained at a period t2.

Then, when the frame mark sensor 25 enters from the last already used frame Fk to the neighboring unused frame Fk+1, one S2 signal corresponding only to the frame mark 21*d* is obtained.

When the regularly obtained S2 signal is changed from the set of two S2 signals to one S2 signal, the control unit CT stops the winding movement (D Stop).

At this point, the frame mark sensor 25 is in a middle of the frame Fk+1, and the thermal head 16 is in a middle of the frame Fk+5.

Here, the first unused frame is the frame Fk+1, so that in order to move the thermal head 16 to the cueing position of the frame Fk+1, the control unit CT moves the intermediate transfer film 21 to the supply reel 22 side by the backward feeding (see an arrow Df in FIG. 25B) (D1 Move Again).

After this re-movement, it is stopped at a fall position of the second S2 signal in the set of S2 signals that has been detected third as the set of S2 signals (D1 Stop).

This second S2 signal in the set of S2 signals that has been detected third corresponds to the frame mark 21*db* at a boundary of the frame Fk−2 and the frame Fk−3, as also shown in FIG. 27.

In this state, the thermal head 16 is at the cueing position of the first unused frame Fk+1, so that the cueing is completed.

There is also a configuration in which the intermediate transfer film 21 is installed/de-installed as a film cartridge with the supply reel 22 and the winding reel 23 housed therein. In this case, when the film cartridge is taken out without winding the intermediate transfer film around one of the reels, after the re-installment, the control unit CT winds the intermediate transfer film 21 around the supply reel 22 or the winding reel 23 once, and carries out the cueing operation in the case of the re-installment described above.

As described above, the image formation apparatus 51 distinguishes the already used frames (including the frame that has failed in a middle of the transfer) and the unused frames of the intermediate transfer film 21, by the control unit CT, according to the frame mark detection information J2 that is the detection signal to be outputted from the frame mark sensor 25. Then, the control unit CT carries out the cueing of the first unused frame next to the already used frame automatically, for the thermal head 16, according to that detection result.

In this way, the image formation apparatus 51 and the printing apparatus PR having the image formation apparatus 51 are capable of carrying out the cueing of the unused frame on the image formation target object (the intermediate transfer film 21) in good quality and efficiency.

The third embodiment of the present invention is not limited to the configuration and the procedure described above, and may be modified in a range not digressing from the essence of the present invention.

In the third embodiment, the exemplary case in which the control unit CT automatically stops the operation at a timing where the error has occurred in a middle of the transfer to the intermediate transfer film 21 has been described, but the control unit CT may automatically stop the operation after carrying out the transfer for all the colors including the already used mark MZ, after the occurrence of the error in a middle of the transfer.

In this case, as the unused frame cueing operation after the error recovery, it suffices to carry out the cueing operation in the case of the re-installment.

The image formation apparatus 51 has been described in the exemplary case of being implemented in the printing apparatus PR in combination with the re-transfer apparatus 52, but it is not limited to this case.

The image formation apparatus 51 may be in combination with the other apparatus. Of course, it may be a single independent apparatus as the image formation apparatus.

The frame mark 21*d* of the intermediate transfer film 21 may not be formed over the entire width. Also, the frame mark 21*d* may not reach an edge portion of the intermediate transfer film 21.

It suffices for the frame mark 21*d* to be capable of being detected by the frame mark sensor 25 along with the already used mark MZ, and to be positioned at a boundary position of each frame F.

Although the present invention has been fully described in connection with the preferred embodiment thereof with reference to the accompanying drawings, it is apparent to those skilled in the art that any changes and modifications are to be understood as included within the scope of the present invention as defined by the appended claims.

The invention claimed is:

1. An image formation apparatus, comprising:

a platen roller;

a thermal head configured to relatively separate/contact with respect to the platen roller, wherein an ink ribbon and an image formation target object are moved in pressed contact between the platen roller and the thermal head and ink of the ink ribbon is transferred to the image formation target object to form an image on the image formation target object, and the image formation target object has a plurality of transfer frames that are partitioned; and a control unit configured to control a formation of the image with respect to at least one of the transfer frames such that the image includes an image of a first range that is transferred and formed in a density within a first density range for which a first density is a maximum density, and an image of a second range that is transferred and formed in a second density that is higher density than the first density, after the first range, wherein the thermal head has n sets of heating resistors, where n is an integer greater than or equal to 2, and the control unit is configured to control the formation of the image such that the image of the second range is transferred and formed independently in correspondence with each one of the n sets of the heating resistors, and wherein the control unit is configured to count a number of times for which each one of the n sets of the heating resistors has a temperature raised into a prescribed temperature range, and control the formation of the image such that the image of the second range is transferred and formed by using those ones of the heating resistors for which the counted number of times reached a prescribed number of times.

2. An image formation method for forming an image on an image formation target object by transferring ink of an ink ribbon to the image formation target object by an image formation apparatus, comprising: a platen roller; a thermal head configured to relatively separate/contact with respect to the platen roller, wherein an ink ribbon and an image formation target object are moved in pressed contact between the platen roller and the thermal head and ink of the ink ribbon is transferred to the image formation target object to form an image on the image formation target object, and the image formation target object has a plurality of transfer frames that are partitioned; and a control unit configured to control formation of the image with respect to at least one of the transfer frames, wherein the method is forming the image with respect to at least one of the transfer frames by:

the first step of transferring and forming an image of a first range in a density within a first density range for which a first density is a maximum density; and the second step of transferring and forming an image of a second range in a second density that is higher density than the first density, after the first step, wherein the thermal head has n sets of heating resistors, where n is an integer greater than or equal to 2, and the control unit is configured to control the formation of the image such that the image of the second range is transferred and formed independently in correspondence with each one of the n sets of the heating resistors, and wherein the control unit is configured to count a number of times for which each one of the n sets of the heating resistors has a temperature raised into a prescribed temperature range, and control the formation of the image such that the image of the second range is transferred and formed by using those ones of the heating resistors for which the counted number of times reached a prescribed number of times.

3. An image formation apparatus, comprising:

a platen roller;

a thermal head configured to relatively separate/contact with respect to the platen roller, wherein an ink ribbon and an image formation target object are moved in pressed contact between the platen roller and the thermal head and ink of the ink ribbon is transferred to the image formation target object to form an image on the image formation target object, and the image formation target object has a plurality of transfer frames that are partitioned; and a control unit configured to control a formation of the image with respect to at least one of the transfer frames such that the image includes an image of a first range that is transferred and formed in a density within a first density range for which a first density is a maximum density, and an image of a second range that is transferred and formed in a second density that is higher density than the first density, after the first range, wherein the thermal head has a heating resistor, and the control unit is configured to count a number of times for which the heating resistor has a temperature raised into a prescribed temperature range, and control the formation of the image such that the image of the second range is transferred and formed when the counted number of times reached a prescribed number of times.

* * * * *